US009010066B1

(12) United States Patent
Sand

(10) Patent No.: US 9,010,066 B1
(45) Date of Patent: Apr. 21, 2015

(54) DOOR AND WINDOW FRAME MOLDING SYSTEM

(71) Applicant: Roar Sand, Ranheim (NO)

(72) Inventor: Roar Sand, Ranheim (NO)

(73) Assignee: Easy Frame, LLC, Denver, CO (US)

( * ) Notice: Subject to any disclaimer, the term of this patent is extended or adjusted under 35 U.S.C. 154(b) by 0 days.

(21) Appl. No.: 14/249,516

(22) Filed: Apr. 10, 2014

(51) Int. Cl.
*E06B 1/10* (2006.01)
*E04F 19/04* (2006.01)
*E04F 13/24* (2006.01)

(52) U.S. Cl.
CPC ..... *E04F 19/0495* (2013.01); *E04F 13/24* (2013.01)

(58) Field of Classification Search
USPC ..... 52/204.53, 204.54, 211–213, 717.01, 52/718.01, DIG. 1, 466, 745.21; 411/458–460; 81/44
See application file for complete search history.

(56) References Cited

U.S. PATENT DOCUMENTS

| | | | | | |
|---|---|---|---|---|---|
| 322,581 | A * | 7/1885 | Clark | 474/191 |
| 3,693,496 | A * | 9/1972 | Koide | 411/458 |
| 3,841,195 | A * | 10/1974 | Jureit | 411/459 |
| 4,157,676 | A * | 6/1979 | Jureit | 411/458 |
| 4,213,374 | A * | 7/1980 | Husler | 411/459 |
| 5,006,006 | A * | 4/1991 | Lehtonen | 403/283 |
| 5,317,853 | A * | 6/1994 | Lopes | 52/456 |
| 5,485,708 | A * | 1/1996 | Johnson | 52/745.16 |
| 5,743,693 | A * | 4/1998 | Sobotker, Jr. | 411/460 |
| 5,791,113 | A | 8/1998 | Glowa et al. | |
| 5,865,586 | A * | 2/1999 | Neville | 411/459 |
| 5,974,745 | A * | 11/1999 | Barr | 52/212 |
| 6,192,638 | B1 * | 2/2001 | Wang | 52/213 |
| 6,393,779 | B1 * | 5/2002 | Boldt | 52/210 |
| 6,679,668 | B2 * | 1/2004 | Martin et al. | 411/388 |
| 7,056,074 | B2 * | 6/2006 | Bas | 411/160 |
| 7,905,698 | B2 * | 3/2011 | Liu et al. | 411/458 |
| 8,024,899 | B2 * | 9/2011 | Prince et al. | 52/211 |
| 8,453,397 | B2 * | 6/2013 | Prince et al. | 52/211 |
| 8,484,913 | B2 | 7/2013 | Charbonneau | |
| 8,534,020 | B2 * | 9/2013 | Burrows et al. | 52/455 |
| 2009/0013636 | A1 | 1/2009 | Wilson | |

* cited by examiner

*Primary Examiner* — Adriana Figueroa
(74) *Attorney, Agent, or Firm* — Marsh Fischmann & Breyfogle LLP; Jonathon A. Szumny

(57) ABSTRACT

Apparatuses, systems, and methods (e.g., "utilities") for use in mounting molding members (e.g., trim, baseboards, etc.) onto and over interfaces between building components (e.g., drywall, studs, framing members, etc.) in a manner that eliminates or at least reduces the need for driving fasteners through the outside surface of the molding members and thus eliminates many of the problems and inefficiencies associated with existing manners of mounting molding members onto building components. At least some of the disclosed utilities include use of a connection member that is configured (e.g., sized) to be disposed or received in a groove of a framing member (e.g., door or window jamb, interconnect member, etc.) or a molding member. The other of the framing member and molding member may include a projecting member that is configured to be received in the groove and engage with a fastening apparatus of the connection member.

5 Claims, 26 Drawing Sheets

DOOR AND WINDOW FRAME MOLDING SYSTEM

FIELD OF THE INVENTION

The invention generally relates to decorative and/or protective molding such as trim and baseboards and, more particularly, to systems and methods for mounting molding to door and window frames, adjacent the bases of walls, and the like.

BACKGROUND OF THE INVENTION

Buildings (e.g., constructed houses, office buildings, etc.) often include a number of standard components such as a foundation, horizontal girders and joists, subflooring interconnected to the joists, vertical studs extending from the girder and joists, drywall (e.g., gypsumboard, sheetrock, plasterboard) secured to the vertical studs, and the like. Part of the process of constructing a building includes creating door and window "rough openings." For instance, a door or window rough opening is typically formed by a pair of spaced vertical stud assemblies (e.g., each including a "jack stud" and a "king stud") interconnected by a (e.g., horizontal) header and possibly by a sill. A frame (e.g., casing) including a plurality of frame members (e.g., spaced jambs or posts, cross/transverse-members interconnecting spaced jambs, etc.) is then inserted into the rough opening and appropriately secured to the studs, header, and/or sill.

In the case of a door frame, for instance, a "hinge jamb" to which a door is hingedly secured may be secured to one of the stud assemblies and a "stop jamb" against which the door abuts to prevent the door from swinging all the way through the door frame may be secured to the other of the stud assemblies. In one arrangement, door frames may include cross-members that interconnect the upper portions of the hinge and door jambs (e.g., such as in the case of pre-hung doors). In the case of a window frame, for instance, a pair of tracks may be respectively attached to the pair of spaced jambs within which a window may slide or travel in first and second opposite directions.

In any event, molding (e.g., baseboards, trim, etc.) is often installed at various locations of a building for purposes of concealing interfaces between structural components, providing for a more aesthetically pleasing appearance, and the like. For instance, baseboards are often mounted over the drywall (e.g., gypsumboard, sheetrock, plasterboard) adjacent the base of interior walls via inserting (e.g., hammering, forcing) fasteners (e.g., nails, staples) through the baseboards (via an outer surface of the baseboards) and into the vertical studs to conceal the interface between the drywall and the floor. As another example, trim is often interconnected or mounted to the jambs and/or frames of doors and windows by inserting fasteners through the trim (via an outer surface of the trim) and into the jambs and/or frames to conceal the interfaces between the door/window frames and the jambs.

SUMMARY OF THE INVENTION

Inserting fasteners (e.g., nails, staples, etc.) through molding and into structural building members (e.g., jambs, frames, studs, etc.) often creates holes (e.g., notches, openings, depressions, cracks, etc.) in the molding (e.g., from the fastener itself, from a hammer or staple gun used to insert the fastener, etc.) that are typically patched (e.g., via joint compound or putty) and/or painted over to conceal the holes. However, it is often difficult to completely conceal such holes which reduces the likelihood of a highly smooth finish on the outside of the molding. Furthermore, driving fasteners though the outside surface of the molding and into the building components can be a cumbersome as it typically requires a nail or staple gun or having to hold nails with one hand and hammer numerous nails with the other hand one at a time. Still further, removal of molding attached in the aforementioned manner (e.g., when painting an adjacent wall, for replacing the molding, etc.) often damages the molding thus limiting its reuse and leading to an increase in waste.

In this regard, disclosed herein are apparatuses, systems, methods, kits, etc. ("utilities") for use in mounting molding members (e.g., trim, baseboards, etc.), decorative pieces, and/or the like onto and over building components (e.g., drywall, studs, etc.) and/or interfaces between building components in a manner that eliminates or at least reduces the need for driving fasteners through the outside surface of the molding members and thus eliminates many of the problems and inefficiencies associated with existing manners of mounting molding members, decorative pieces, and/or the like onto building components. As will be discussed in more detail herein, at least some of the disclosed utilities include use of a connection member that is configured (e.g., sized, shaped, etc.) to be disposed or received in a groove of a framing member (e.g., door or window jamb, interconnect member, etc.) or a molding member (or a decorative piece). In one arrangement, the connection member may broadly include a base member (e.g., in one embodiment, a generally planar member, such as one or more strips or layers of material) along with a fastening apparatus disposed on at least one side of the base member so as to face or be directed away from the base member towards and/or past an entrance to the groove. The other of the framing member and molding member may include a projecting member that is configured to be received in the groove and engage with the fastening apparatus of the connection member.

As just one non-limiting example, assume some or all of a door or window frame (e.g., including a pair of spaced jambs and a top member interconnecting the jambs) includes a groove (e.g., track, etc.) running therealong. Further assume that one or more connection members, each in the form of a base member having a series of spaced fasteners (e.g., nails, staples, etc.) extending away from opposite sides thereof, are placed or disposed in the groove (e.g., so that the fasteners of one of the sides at least partially engage a (e.g., bottom, back, etc.) surface of the groove). After a projecting member of a molding member (e.g., where the projecting member has a width and height corresponding to the width and depth of the groove) is aligned with the groove, the projecting member may be inserted (e.g., urged, forced) into the groove so as to engage with the fasteners of the connection member and mount the molding member to the framing member.

For instance, any appropriate tool (e.g., rubber mallet or the like) may be used to apply a force to the outside of the molding member (e.g., a side opposite of the side on which the projecting member is disposed) so as to drive the projecting member into the groove. As the projecting member is being driven into the groove, the fasteners on one side of the base member may pierce and be driven into the projecting member while the fasteners on the opposite side of the base member may pierce and be driven into the surface of the groove. Continued driving of the projecting member into the groove may eventually substantially sandwich (e.g., compress) the base member between the projecting member and the bottom surface of the groove. The fasteners may be of a length so as to not protrude through the front surface of the molding members when seated in the groove. At this point, the molding member may be mounted to the framing member, a covering portion of the molding member may cover an interface (e.g., abutment or substantial abutment) between the framing member and a building component (e.g., drywall, stud, etc.), and the connection member may be concealed (e.g., hidden) from view within the groove and/or between the molding member and the framing member.

As an example, respective molding members may be similarly mounted about the various framing members of the frame. While the opposite sides of the base member of the connection member have each been described as including a series of protruding fasteners, one or both sides may additionally or alternatively include other fastening apparatuses such as adhesives (e.g., which may be covered by a releasable strip of material before use) and/or the like. Furthermore, the disclosed utilities also include a vice versa arrangement whereby the groove is disposed in a surface of the molding member and the projecting member is disposed on the framing member.

In one arrangement, one or both of the framing member and molding member may include an extension member that is configured to space the covering member of the molding member away from a building component. This arrangement may be useful when drywall is to be mounted over a stud onto which the framing member is secured and/or over other paneling. For instance, the extension member may include opposite sides, where one of the sides includes a projecting member that is configured to be received into the groove of one of the framing member and the molding member, and where the other of the sides includes a groove that is configured to receive the projecting member of the other of the framing member and the molding member. In this arrangement, respective connection members may be disposed in the groove of the extension member and the groove of the framing or molding member as discussed previously.

In contrast to existing arrangements, the disclosed utilities allow molding members to be mounted and secured over building component interfaces (e.g., between framing members and studs, between framing members and drywall, etc.) free of having to drive fasteners through the molding members into the building components via an outside surface of the molding members. More specifically, placement of a connection member within a groove of a framing member over which a molding member is disposed (or within a groove of the molding member that faces the framing member) effectively interconnects the molding member to the framing member while concealing the connection member (e.g., and/or fasteners) and eliminating (or at least reducing) the need to drive fasteners all the way through the molding member via an outside surface of the molding.

Furthermore, receiving (e.g., inserting, forcing) a projecting member (on the other of the molding member and framing member) into the groove so as to engage the fastening apparatus (e.g., fasteners, adhesives, and/or the like) of the connection member advantageously serves to simultaneously laterally stabilize the molding member (e.g., due to abutment or substantial abutment between the outside surfaces of the projecting member and the inside surfaces of the groove) and secure the molding member against inadvertent removal from the framing member. Still further, the molding member can be efficiently and quickly removed from the framing member free or substantially free of damaging the molding member and/or building components, such as by sliding a blade or the like between the molding member and the building component and prying (e.g., torquing) the molding member away from the building component and framing member (e.g., so as to remove the projecting member from the groove and thus out of engagement with the connection member).

In one aspect, a system for use with an opening in a building is disclosed, where the opening is defined by a plurality of structural members (e.g., studs, headers, etc.). The system includes a framing member (e.g., jamb) securable to one of the plurality of structural members, where the framing member includes one of a projecting member and a groove, and where the groove is defined by at least surface. The system also includes a molding member including the other of the projecting member and the groove, where the projecting member is receivable in the groove, and a connection member receivable in the groove when the projecting member is received in the groove to secure the molding member to the framing member.

For instance, the connection member may include a body including first and second opposite surfaces, and a fastening apparatus (e.g., series of protruding fasteners, adhesives, etc.) disposed on at least one of the first and second surfaces of the body, where the fastening apparatus is interconnectable to one of the projecting member and the surface of the groove.

In another aspect, a kit for concealing an interface between adjacent components of a building includes an elongated molding member including a body having first and second sides, and a connection member configured to attach the molding member to one of the components over the interface between the adjacent components. The first side of the body is configured to face in a first direction towards the interface and the second side is configured to face in a second direction that is opposite to the first direction. The first side of the body includes a projecting member thereon that is receivable within a groove defined by a surface of one of the components of the building. The connection member includes a body including first and second opposite surfaces, where the first surface is configured to face in the first direction, where the second surface is configured to face in the second direction, and where the body is receivable in the groove between the surface of the component and the projecting member. The connection member also includes a fastening apparatus disposed on the first surface of the body, where the fastening apparatus is configured to engage with the surface of the component that defines the groove.

In a further aspect, a kit for concealing an interface between adjacent components of a building includes an elongated molding member including a body having a groove on a side thereof, where the groove is defined by at least one surface in the side of the body. The kit also includes a connection member including a body receivable in the groove and a fastening apparatus on a second of first and second opposite surfaces of the body. The first surface is configured to face in a first direction towards the surface of the groove and the second surface is configured to face in a second direction opposite to the first direction. The fastening apparatus is configured to secure the molding member over the interface between the adjacent components of the building.

In a still further aspect, a method of mounting a molding member over an interface between a framing member and a component of a building is disclosed, where the molding member includes one of a groove and a projecting member, and where the framing member includes the other of a groove and a projecting member. The method includes disposing a connection member at least partially into the groove, where the connection member includes a body having first and second opposite surfaces, where the connection member includes a first fastening apparatus on the first surface of the body, and where the connection member includes a second fastening apparatus on the second surface of the body. The method also includes first engaging, during the disposing, the first fastening apparatus with a surface defining the groove;

aligning the one of the groove and projecting member of the molding member with the other of the groove and projecting member of the framing member; receiving the projecting member in the groove; and second engaging, during the receiving, the projecting member with the second fastening apparatus to mount the molding member over the interface, where the body is disposed within the groove between the projecting member and the surface of the groove.

Various refinements may exist of the features noted in relation to the various aspects. Further features may also be incorporated in the various aspects. These refinements and additional features may exist individually or in any combination, and various features of the aspects may be combined. In addition to the exemplary aspects and embodiments described above, further aspects and embodiments will become apparent by reference to the drawings and by study of the following descriptions.

DESCRIPTION OF THE DRAWINGS

For a more complete understanding of the present invention and further advantages thereof, reference is now made to the following Detailed Description, taken in conjunction with the drawings, in which.

DETAILED DESCRIPTION

Reference will now be made to the accompanying drawings to assist in illustrating and describing the various pertinent features of the various novel aspects of the present disclosure. While many of the disclosed utilities (e.g., connection members, methods of mounting molding to building components, etc.) will be shown and described in the context of door frames, window frames, wall/floor interfaces, and the like, it is to be understood that the disclosed utilities may also find use in numerous other contexts in which it is desired to mount or attach a first item or member to a second item or member free of driving fasteners (e.g., screws, nails, pins, etc.) entirely through the first member (e.g., from an outside surface of the first member) and into the second member. Stated differently, the disclosed utilities may find use in almost any context in which a hidden fastening apparatus or method is desired for mounting or attaching one item to another item. In this regard, the following description is presented for purposes of illustration and description and is not intended to limit the inventive aspects to the forms disclosed herein. Consequently, variations and modifications commensurate with the following teachings, and skill and knowledge of the relevant art, are within the scope of the present inventive aspects.

Figure 1:
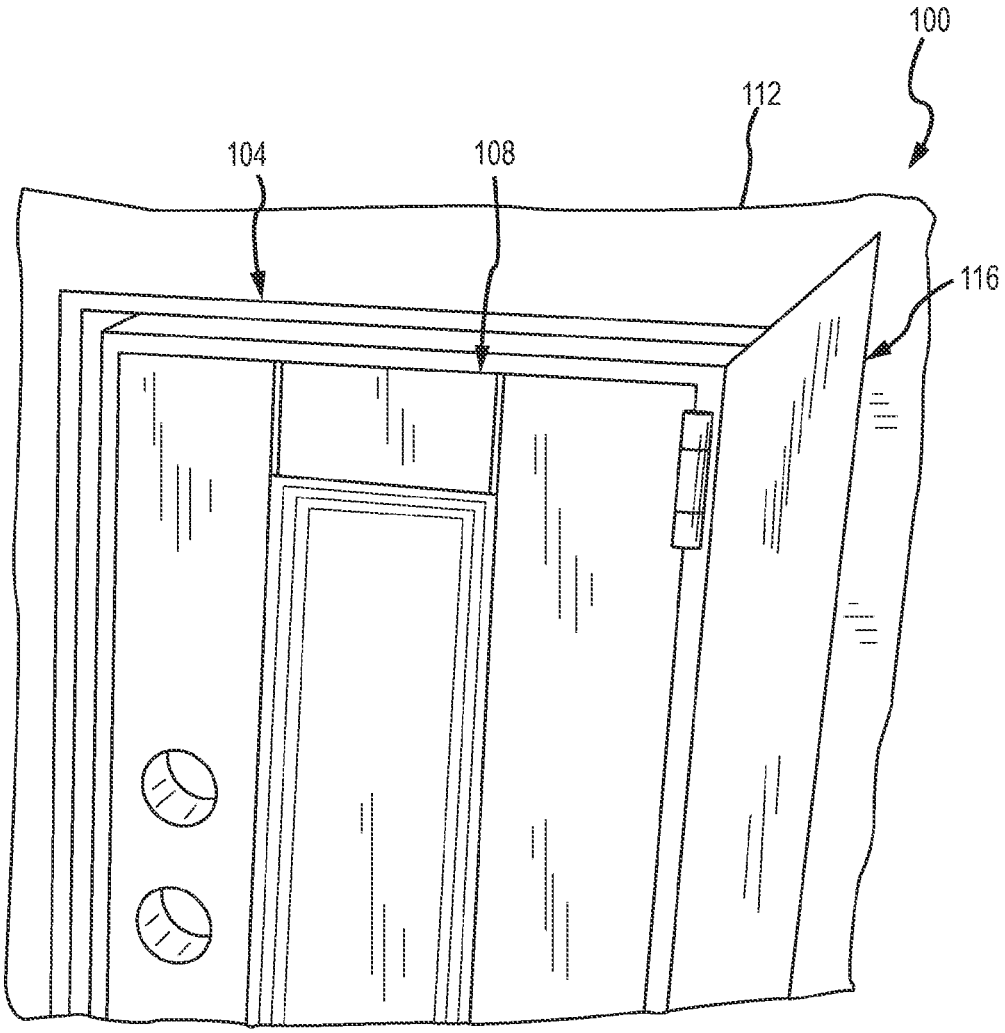
FIG. 1 is a perspective view of a partially assembled door structure according to one embodiment.

With initial reference to FIG. 1, a perspective view of a partially assembled door structure 100 according to one embodiment is illustrated. Broadly, the door structure 100 includes a frame 104 (e.g., casing) to which a door 108 may be appropriately secured in any appropriate manner (e.g., via hinges, etc.). Any appropriate paneling 112 (e.g., drywall, wood, combinations thereof, etc.) may be secured to and over any appropriate subframe (e.g., including structural components such as studs, headers, etc., not shown in FIG. 1) to which the frame 104 is secured so as to conceal the subframe. One or more molding members 116 (e.g., trim, etc.) may be secured to the frame 104 so as to conceal an interface between the frame 104 and the paneling 112 (e.g., and or between the frame 104 and the subframe) as will be discussed in more detail herein.

Figure 2:
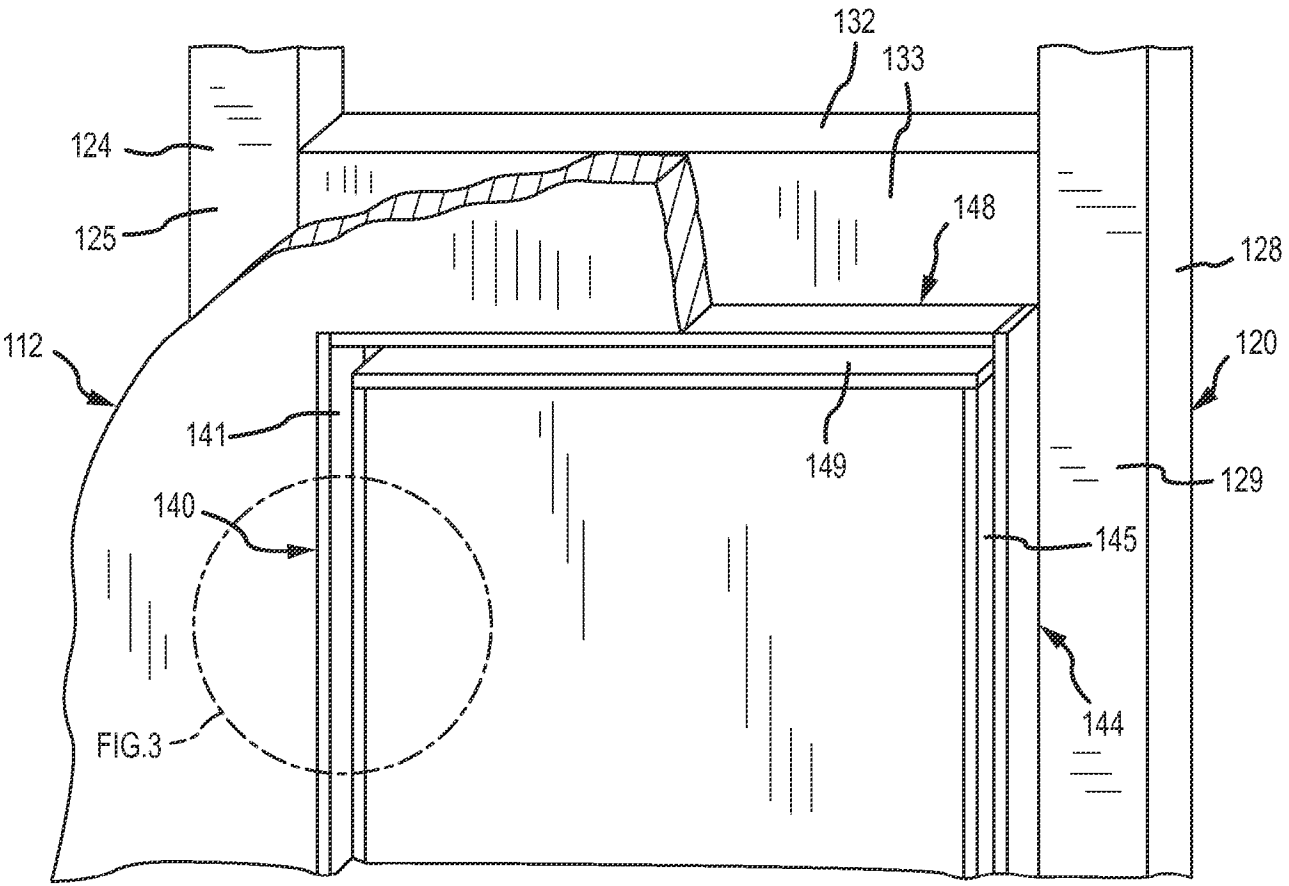
FIG. 2 is another perspective view of the door structure of FIG. 1 with the door removed and illustrating structural building components used to form a rough opening for a door frame.

FIG. 2 presents another perspective view of the door structure 100 of FIG. 1 with the door 108 and a portion of the paneling 112 removed and illustrating a portion of a subframe 120 onto which the frame 104 and paneling 112 may be mounted and secured in any appropriate manner. For instance, the subframe 120 may include a plurality of structural members or components such as first and second (e.g., vertical and parallel) stud assemblies 124, 128 (e.g., each includes a king and/or jack stud of any appropriate materials and dimensions) and a header 132 (of any appropriate materials and dimensions) appropriately interconnected between the first and second stud assemblies 124, 128 to form a rough opening 136 into which the frame 104 may be inserted and disposed for attachment to the subframe 120.

More specifically, the frame 104 may include a plurality of framing members such as first and second jamb members 140, 144 respectively attached (e.g., via fasteners or the like) to inside surfaces of the first and second stud assemblies 124, 128 as well as a cross member 148 that interconnects the first and second jamb members 140, 144 and that is attached (e.g., via fasteners or the like) to a bottom surface of the header 132 (e.g., where the cross member 148 is generally perpendicular to the first and second jamb members 140, 144 and/or at other angles thereto). In one arrangement, the first and second jamb members 140, 144 and cross member 148 may be mounted so as to respectively extend past or otherwise protrude from front surfaces 125, 129, 133 of the first and second stud assemblies 124, 128 and header 133. While the subframe 120 and frame 104 have been discussed in the context of the door 108, the various teachings herein may also be applicable to subframes 120 and frames 104 for other components such as windows and the like. Furthermore, various details of the subframe 120 (e.g., how header 132 is secured to the first and second stud assemblies 124, 128, how the subframe 120 interconnects to the overall frame of a building or house, etc.) and frame 104 (e.g., how the framing members are secured to the subframe 120, hinges and door stops of the first and second jamb members 140, 144, etc.) are not discussed in the interest of brevity.

In any event, one or more of the framing members of the frame 104 may include a groove (e.g., slot, depression, track, etc.) therealong for receipt of a connection member and a portion of a molding member as will be discussed in more detail below. As shown in FIG. 2, for instance, the first and second jamb members 140, 144 and cross member 148 may include respective grooves 141, 145, 149 at least partially therealong. In one arrangement, each of the grooves 141, 145, 149 may extend along a longitudinal length of its respective framing member, such as in an orientation in which a molding member (e.g., trim, etc.) is desired to be mounted relative thereto.

Figure 3A:
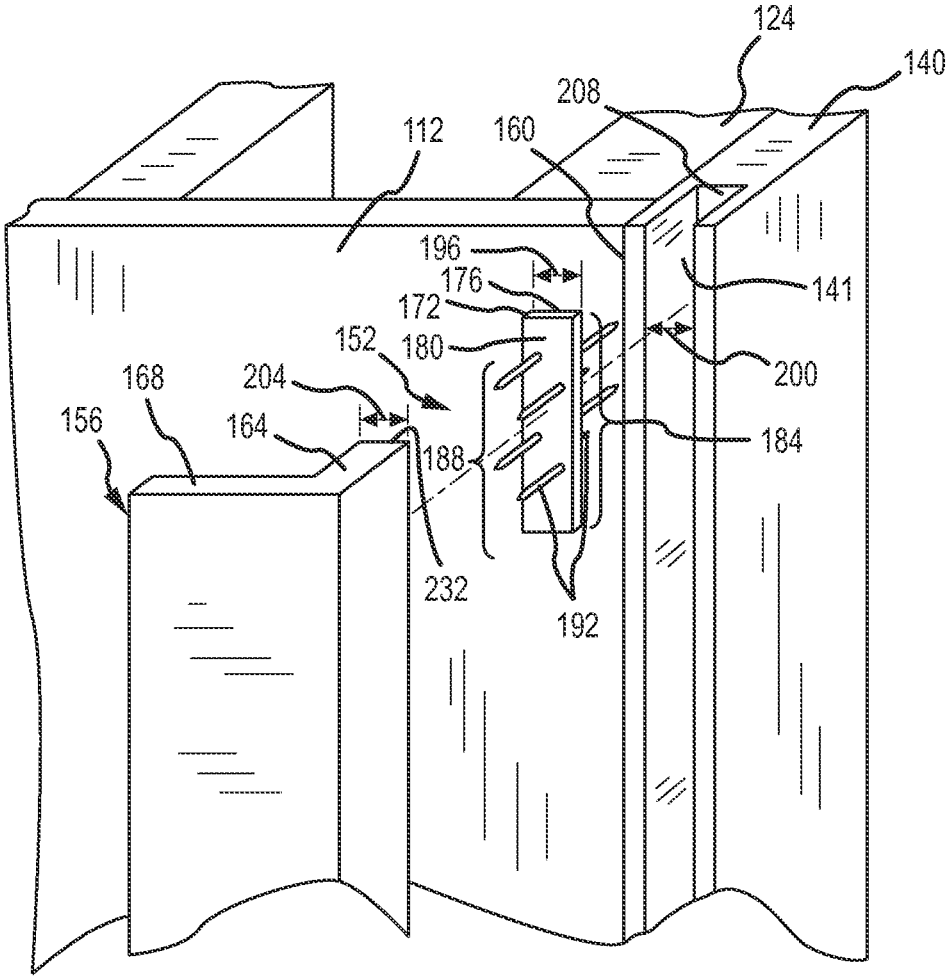
FIG. 3*a* is an exploded perspective view of a system for mounting molding onto a frame of a door according to an embodiment.
Figure 21A:
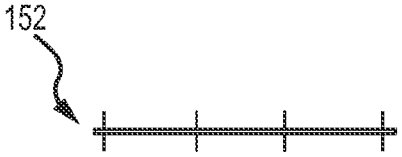
FIG. 21*a* is a side view of the connection member of FIG. 3*a*.
Figure 21B:
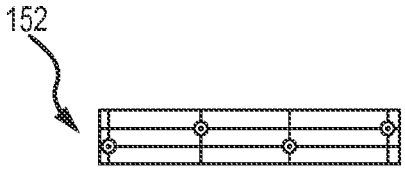
FIG. 21*b* is a plan view of the connection member of FIG. 3*a*.
Figure 21C:
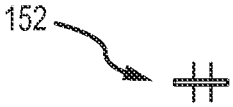
FIG. 21*c* is an end view of the connection member of FIG. 3*a*.

Turning now to FIG. 3*a*, an exploded perspective view of a portion of the structure of FIG. 2 is presented, where the first jamb member 140 is attached to the first stud assembly 124 and the paneling 112 is secured over the first stud assembly 124. Also illustrated is a connection member 152 (also see FIGS. 21*a*-21*c*) that may be used to secure a molding member 156 to the first jamb member 140 to allow the molding member 156 to cover or conceal an interface 160 (e.g., gap, joint, abutment) between the first jamb member 140 and the paneling 112 (e.g., and/or between the first jamb member 140 and the first stud assembly 124 in the event paneling 112 was not secured over the first stud assembly 124).

Broadly, the connection member 152 may be receivable in the groove 141 and may serve to interconnect a projecting member 164 of the molding member 156 to the first jamb member 140 so that a cover member 168 of the molding member 156 may conceal the interface 160 (e.g., where the projecting member 164 extends at an angle from the cover member, such as 90°, 120°, etc.). As shown, the connection member 152 may include a body 172 (e.g., base member) having first and second opposite surfaces 176, 180 (e.g., that are parallel to each other) as well as at least one fastening apparatus disposed on one of the first and second surfaces 176, 180, such as a first fastening apparatus 184 disposed on or connected to the first surface 176 and a second fastening apparatus 188 disposed on or connected to the second surface 180.

Figure 22:
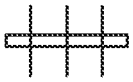
FIG. 22 is a side view of a connection member according to another embodiment.

In one arrangement and as shown in FIG. 3*a*, each of the first and second fastening apparatuses 184, 188 may be in the form of a plurality of fasteners 192 (e.g., nails, staples, etc., such as four as shown in the figures or any other appropriate number, see embodiment of connection member 152''''' in FIG. 22) extending or protruding away from the first and second surfaces 176, 180, respectively (e.g., in opposite directions away from the first and second surfaces 176, 180). In one embodiment, the fasteners 192 may be substantially collinearly arranged on the surface(s) of the base member. In another embodiment, the fasteners 192 may be staggeredly arranged on the surface(s) of the base member 172. In another embodiment, each of the first and second fastening apparatuses 184, 188 may include two or more rows of collinearly arranged fasteners 192. In another embodiment, one or both of the fastening apparatuses 184, 188 may additionally or alternatively include an adhesive disposed over the first and/or second surface 176, 180 (e.g., such as an adhesive with a releasable cover thereover, where the cover could be removed before insertion of the connection member 152 into the groove 141).

Figure 9:
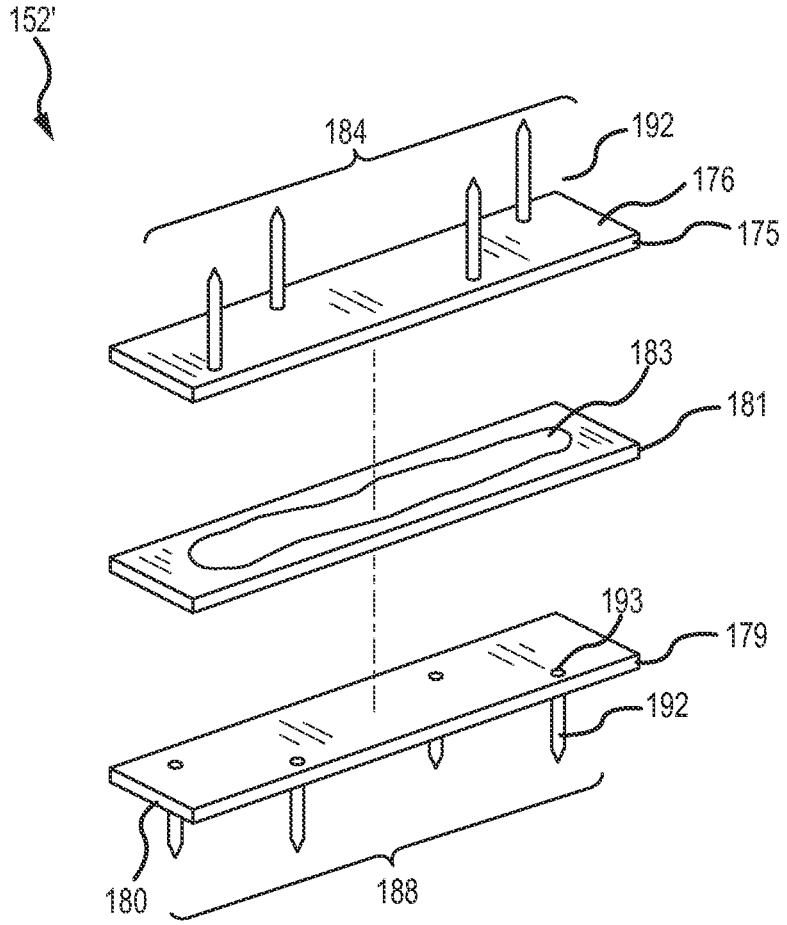
FIG. 9 is an exploded perspective view of a connection member according to an embodiment.

The connection member 152 may be constructed of any appropriate material(s) (e.g., plastic, vinyl, wood, metals such as steel and/or magnetic material, various combinations thereof, and/or the like) to facilitate interconnection between the molding member 156 and the first jamb member 140 and/or other framing members and building components. As just one example, FIG. 9 presents an exploded perspective view of one embodiment of an embodiment of the connection member 152'. As shown, the body 172 may include one or more strips (e.g., layers, plates, etc.) of any appropriate material(s) such as a first layer 175 (e.g., constructed of plastic or metal) that includes the first surface 176 of the body 172, a second layer 179 that includes the second surface 180 of the body 172, and an intermediate layer 181 (e.g., constructed of plastic or metal such as steel) for interconnecting the first and second layers 175, 179 as well as providing strength to the connection member 152.

As an example, each of the first layer 175, second layer 179 and intermediate layer 181 may be initially formed in any appropriate manner. In the case of the first and second layers 175, 179, for instance, the various fasteners 192 may be secured to the layers during any appropriate molding process (e.g., insert molding, injection molding) so as to respectively project away from the first and second surfaces 176, 180. Alternatively, a pre-formed sheet may be appropriately cut into the first and second layers 175, 179 and then the fasteners 192 may be appropriately driven through the first and second layers 175, 179 until heads 193 of the fasteners 192 are in contact with the first and second layers 175, 179. The intermediate layer 181 may also be formed in any appropriate manner such as stamping, casting, cutting, and/or the like.

Once the various layers have been formed in any appropriate manner, the layers may be interconnected to form a completed connection member 152. As one example, any appropriate adhesive 183 may be applied to opposite surfaces (not labeled) of the intermediate layer 181. The first layer 175 (e.g., the surface of the first layer 175 on which the heads 193 of the fasteners 192 are disposed) may then be put in contact with one surface of the intermediate layer 181 and the second layer 179 may be put in contact with the opposite surface of the intermediate layer 181 so that the fasteners 192 of the first and second fastening apparatuses 184, 188 extend in opposite directions. The various layers may then be pressed and held together in any appropriate manner until the adhesive 183 has cured. As an alternative to the adhesive 183, the various layers may be heated (e.g., so as to melt or at least partially flow) and subsequently fused together. Various other manners of pressing, bonding, adhering, securing, etc. the layers together are envisioned and encompassed in the present disclosure.

Figure 10:
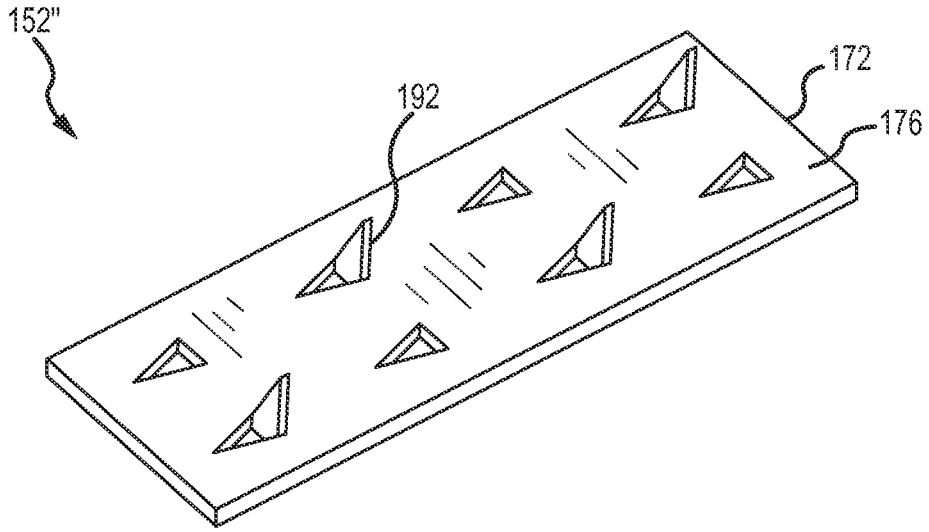
FIG. 10 is a perspective view of a connection member according to an embodiment.

In one arrangement, the connection member 152 may be in the form of a single layer having opposite surfaces from which the fasteners 192 project. For instance, the various fasteners 192 may be seated directly into the single layer so as to extend away from the opposite surfaces of the single layer during any appropriate molding process (e.g., insert molding, etc.) of the single layer. As another example, the single layer may be constructed of metal or the like, where the various fasteners 192 may be punched out from opposite surfaces of the single layer and as seen in the embodiment of the connection member 152" of FIG. 10. The various connection members 152 disclosed herein may be constructed via any appropriate manual and/or automated processes.

Figure 11:
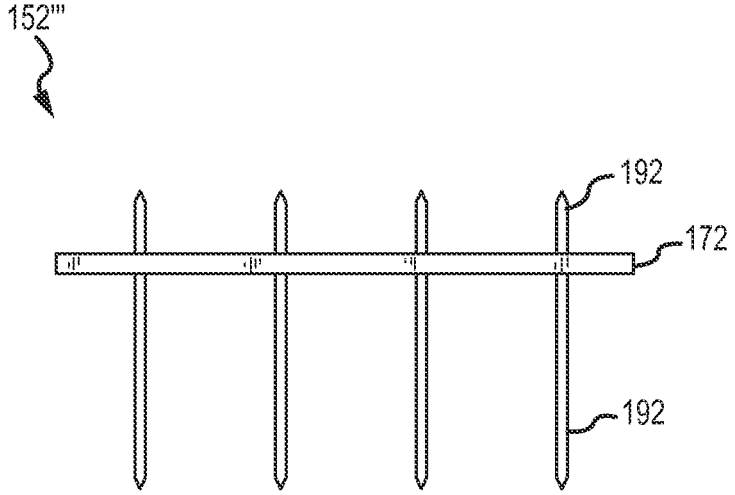
FIG. 11 is a side view of a connection member according to an embodiment.

While the length of the fasteners 192 of the first fastening apparatus 184 is illustrated in FIG. 3*a* as being generally the same as that of the fasteners 192 of the second fastening apparatus 188, some arrangements disclosed herein envision that the lengths may be different. See the embodiment of the connection member 152'" in FIG. 11. This embodiment may be advantageous in arrangements whereby the fasteners 192 need to travel all the way through paneling (e.g., drywall) before piercing a stud or other structural member (e.g., such as in the embodiment illustrated in FIG. 15 discussed below). In some arrangements, one or more of the fasteners 192 may extend at non-perpendicular angles (e.g., 45°, 60°, etc.) relative to the surface from which they extend. In any case, and to mount the molding member 156 to the first jamb member 140 so as to conceal the interface 160, the connection member 152 may be disposed (e.g., inserted) into the groove 140 so that the first fastening apparatus 184 at least partially engages a surface that at least partially defines the groove 141 (e.g., such as an inner back surface 208 of the first jamb member 140). To allow for insertion or disposal of the connection member 152 into the groove 141, a width 196 of the body 172 may be substantially equal to or less than a width 200 of the groove 141. Similarly, a width 204 of the projecting member 164 of the molding member 152 may be substantially equal to or less than the respective widths 196, 200 of the body 172 and the groove 141.

Figure 4:
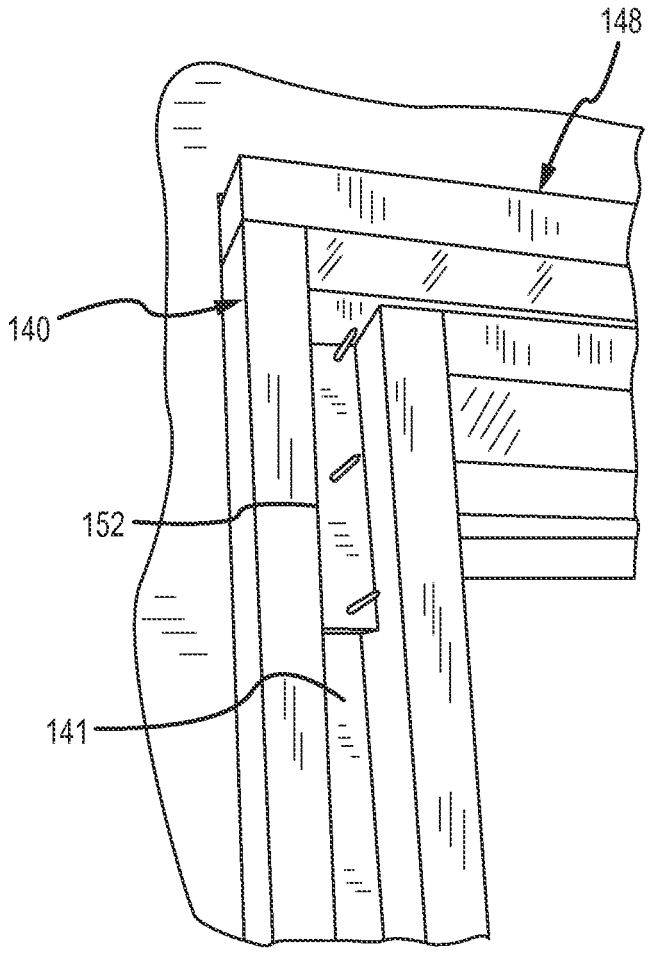
FIG. 4 is a perspective view of the embodiment of FIG. 3 but after a connection member has been disposed into a groove of a framing member of the frame.
Figure 5A:
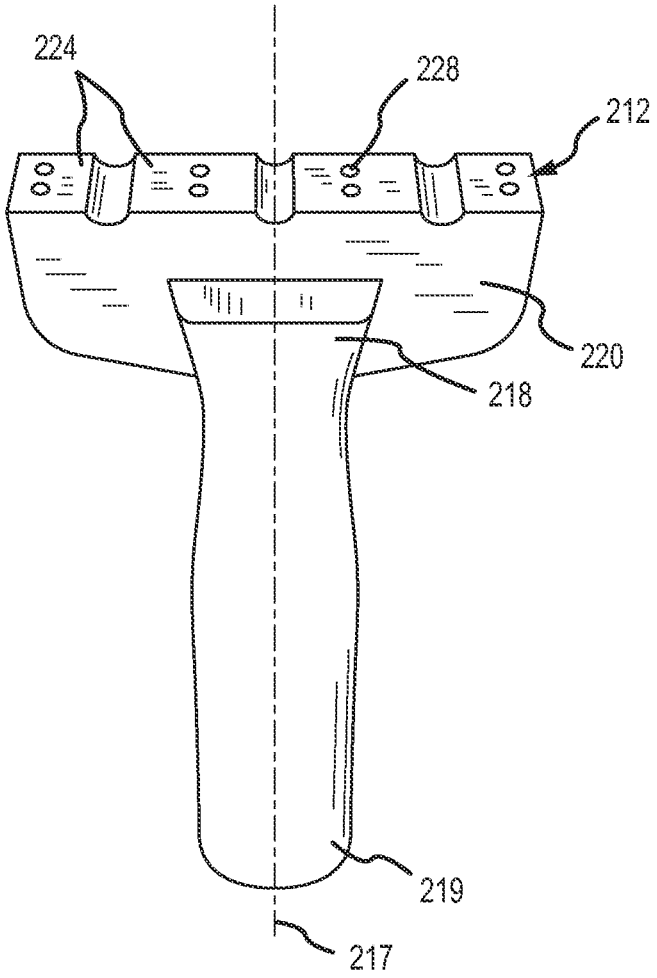
FIG. 5*a* is a perspective view of a tool for installing a connection member into a groove of a framing member or a molding member.
Figure 5B:
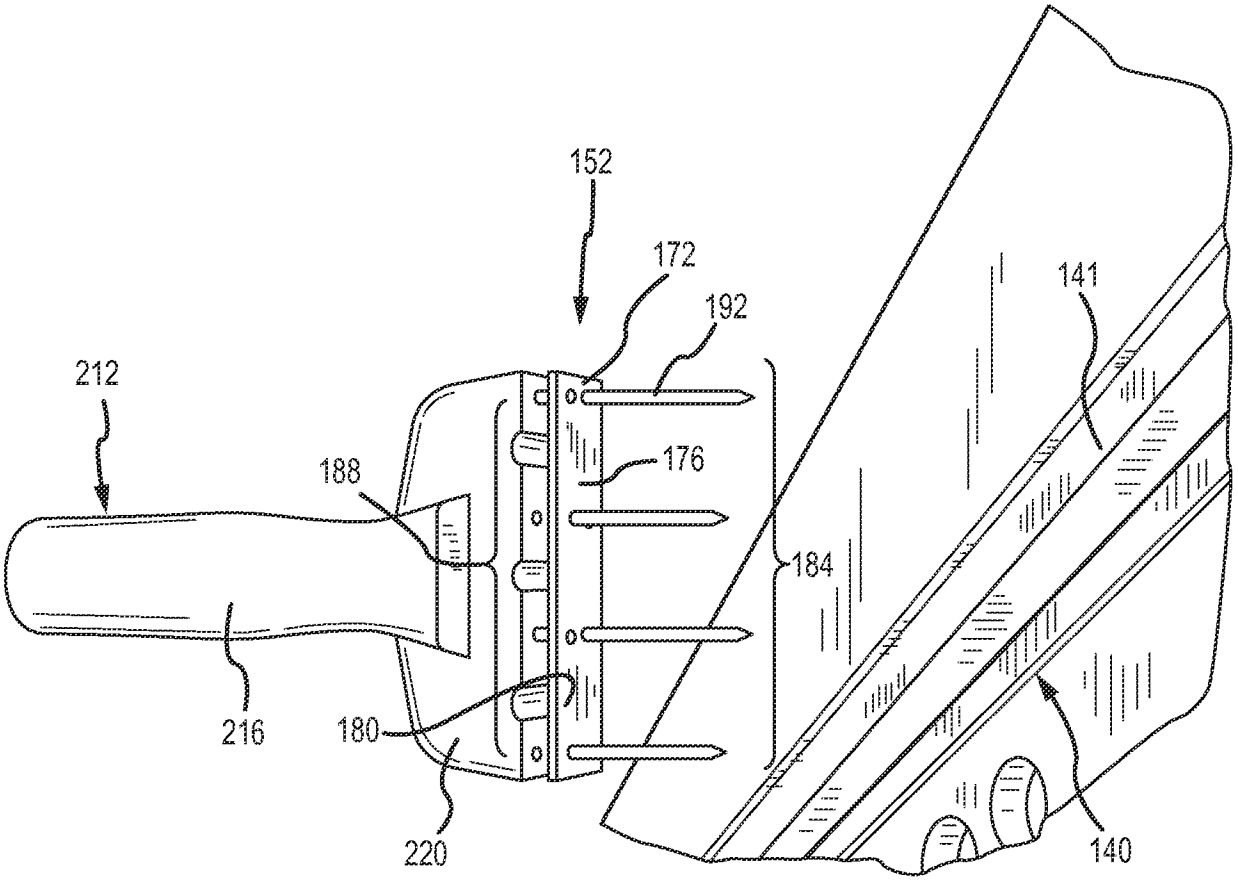
FIG. 5*b* is another perspective view of the tool of FIG. 5*a* and showing a connection member being attached to the tool.
Figure 5C:
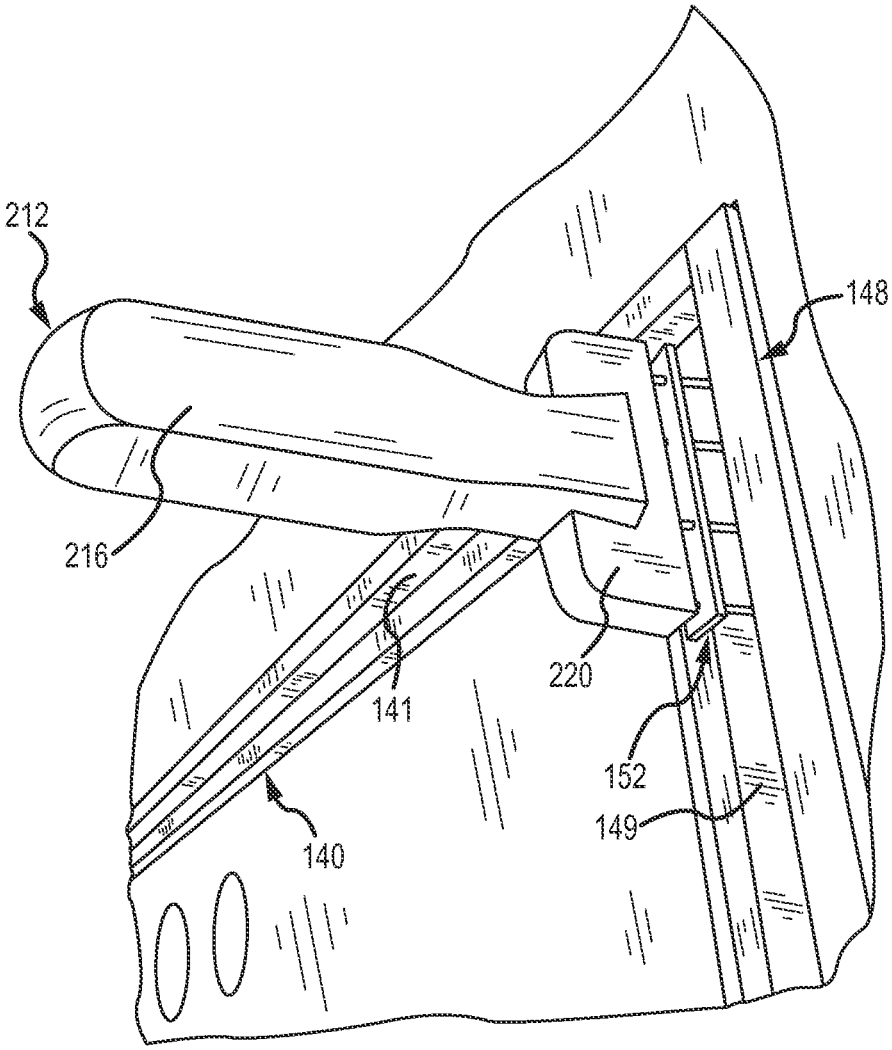
FIG. 5*c* is a perspective view showing the tool of FIG. 5*a* being used to insert the connection member into a groove of a framing member.

For instance, the connection member 152 may be forced into the groove 141 (e.g., via any appropriate tool) so that the fasteners 192 at least partially pierce the back surface 208 to seat the connection member 152 in the groove. See FIG. 4. In one arrangement and as shown in FIGS. 5*a*-5*c*, a tool 212 may be provided to insert and seat the connection member 152 in the groove 141. As shown, the tool 212 may include a handle 216 having opposite first and second ends 219, 218 and a mounting head 220 rigidly connected to the second end 218 of the handle 216. A longitudinal axis 217 may extend through the first and second ends 219, 218. The mounting head 220 may include a mounting surface 224 that includes a plurality of apertures 228 that are respectively configured to receive the fasteners 192 of the first and second fastening apparatuses 184, 188. For instance, the mounting surface 224 may generally reside in a reference plane (not labeled) that is substantially perpendicular to the longitudinal axis 217. In an arrangement, the plurality of apertures 228 may be arranged into a plurality of rows of apertures 228 for use in receiving a staggered arrangement of fasteners 192 of a connection member 152. In an arrangement, the apertures 228 may stop short of extending all of the way through the mounting head 220 to form a bottom or lower surface against which the fasteners may be disposed.

In use, a user may grasp the connection member 152 and then align and at least partially insert the fasteners 192 of the second fastening apparatus 188 into the apertures 228 on the mounting surface 224 of the mounting head 220. See FIGS. 5*a*-5*b*. The user may then grasp the handle 216 of the tool 212 and insert the connection member 152 into the groove 141. For instance, FIG. 5*c* illustrates the tool 212 being used to insert a connection member 152 into the groove 149 of the cross member 148 (where the tool 212 could be similarly used to insert the connection member 152 into the groove 141 of the first jamb member 140 and/or the grooves of other framing members). As the user encounters resistance when the ends of the fasteners 192 of the first fastening apparatus 192 begin engaging the back surface 208 of the groove 141, the user may continue urging the connection member 152 into the groove 141 against the encountered resistance to drive the fasteners 192 further through the back surface 208 and into the first jamb member 140. For instance, urging of the tool 212 may cause the mounting surface 224 of the mounting head 220 to engage and apply a corresponding force against the second surface 188 of the base 172 of the connection member 152 so as to drive the fasteners 192 through the back surface 208 (e.g., such as until the first surface 184 of the base member 172 abuts or substantially abuts the back surface 208 of the groove 141).

In one embodiment, a single connection member 152 may be seated in the groove 141 as discussed above, where a length of the single connection member 152 may or may not be substantially the same as that of the groove 141 (e.g., from a first, top end to a second, bottom end of the groove 141). In another embodiment, a plurality of shorter connection members 152 may be seated in the groove as discussed above, where a combined length of the plurality of shorter connection members 152 may or may not be the same as that of the groove 141. As just one example, a user may install a first connection member 152 adjacent one end of the groove 141, a second connection member 152 adjacent a midpoint of the groove 141, and a third connection member 152 adjacent an opposite end of the groove 141.

Figure 6:
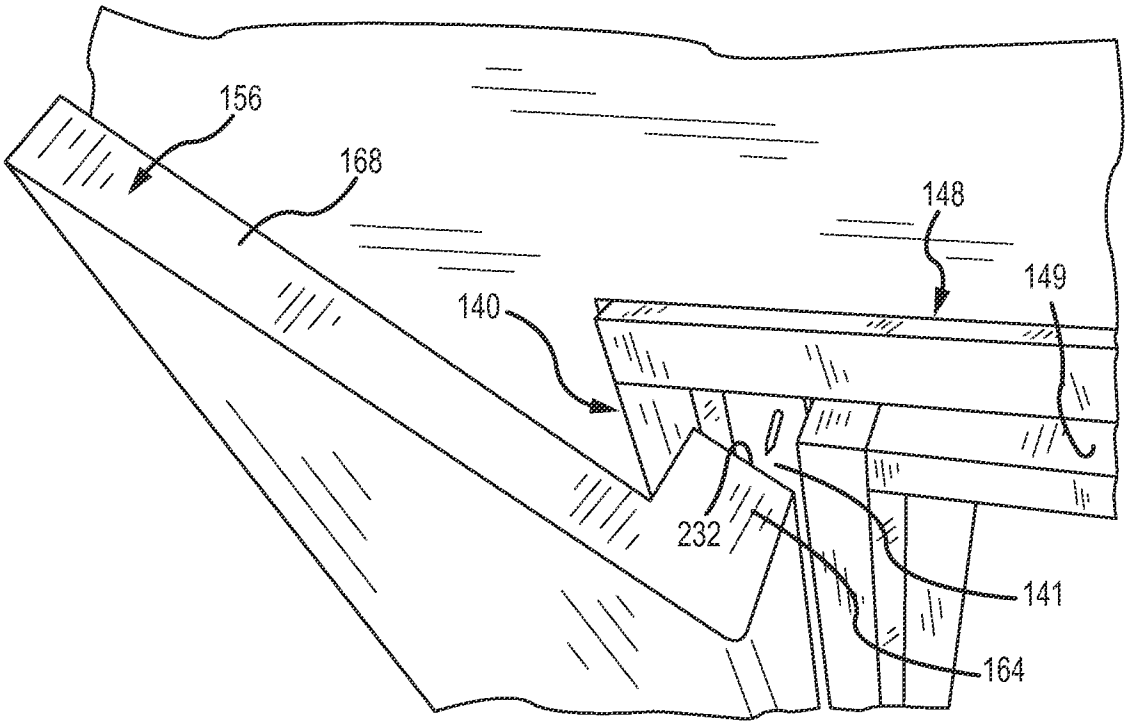
FIG. 6 is a perspective view of the embodiment of FIG. 4 and illustrating a molding member being installed into the groove of the framing member.

Once one or more connection members 152 have been seated in the groove 141 as discussed above, the molding member 156 may be seated in the groove and attached to the connection member(s) 152 to mount the molding member 156 to the first jamb member 140. For instance, and with reference to FIGS. 3*a* and 6, a user may grasp the molding member 156 and align the projecting member 164 with the groove 141. The user may then cause the projecting member 164 to be received in the groove 141 (e.g., via inserting the projecting member 164 into the groove 141) and engage with the second fastening apparatus 188 of the connection member 152. In one arrangement, the user may utilize a hammer or mallet (e.g., rubber mallet) to hammer or exert a force on an outside surface of the molding member 156 to cause the fasteners 192 of the second fastening apparatus 188 to pierce an end surface 232 of the projecting member 164. Continued hammering or urging of the projecting member 164 into the groove 141 may eventually result in sandwiching or compressing of the base member 172 of the connection member 152 by the end surface 232 of the projecting member and the back surface 208 of the groove 141.

At this point, the first and second fastening apparatuses 184, 188 may be respectively engaged with the first jamb member 140 and the projecting member 164 (e.g., the fasteners 192 are substantially seated in the projecting member 164 and the first jamb member 140) thus securing the molding member 156 to the first jamb member 140. See FIG. 3*b*. Additionally, the cover member 168 of the molding member 156 conceals or covers the interface 160. Use of the connection member 152 advantageously inhibits inadvertent dismounting or removal of the projecting member 164 (e.g., in a direction perpendicular and/or parallel to the back surface 208) and thus the molding member 156 from the groove 141 (and thus the first jamb member 140). Furthermore, the simultaneous placement or disposal of the projecting member 164 in the groove 141 increases lateral stability of the molding member 156, such as by limiting side to side movement of the molding member 156 in directions parallel to the front surface of the paneling 112.

Figure 3B:
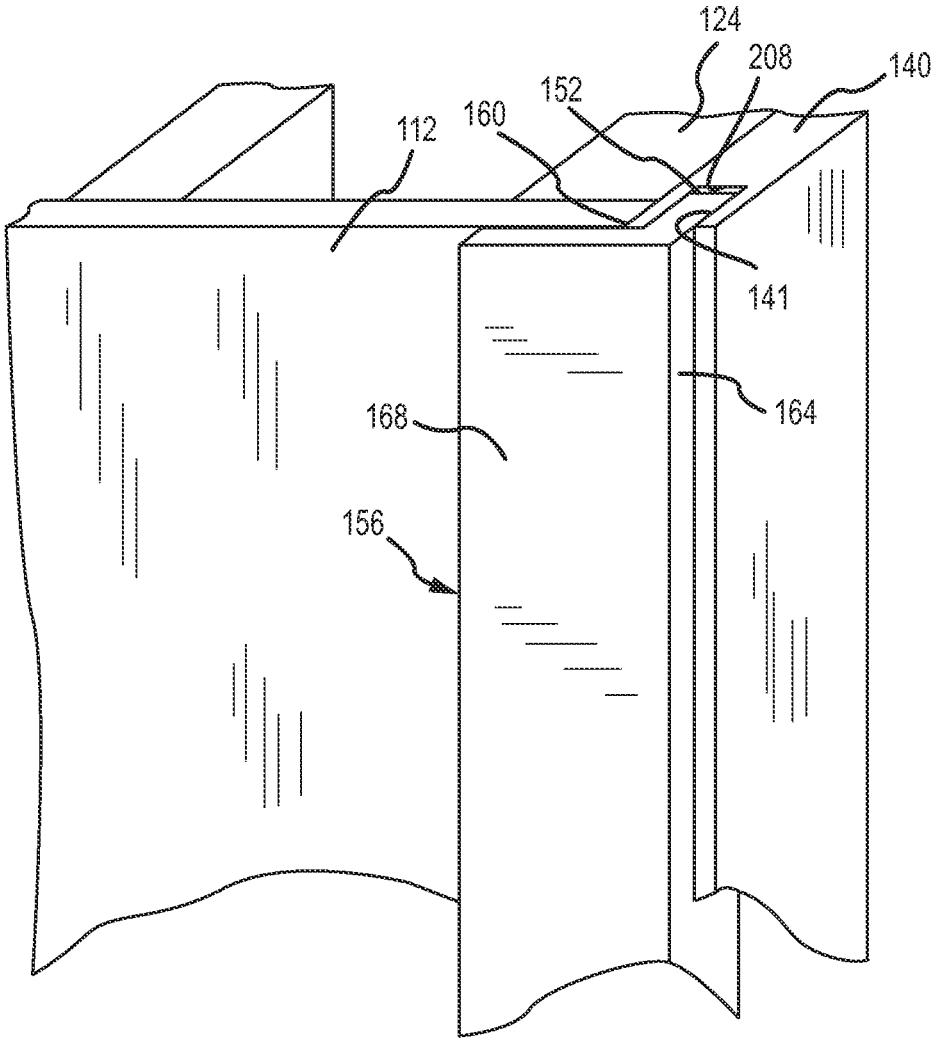
FIG. 3*b* is a perspective view similar to FIG. 3*a* but where the molding is mounted onto the frame of the door.

The combined seating of the connection member 152 and the projecting member 164 in the groove 141 also facilitates intended removal of the molding member 156 from the first jamb member 140 and thus separation from the paneling 112 substantially free of damage to the molding member 156, paneling 112, and the like. With reference to FIG. 3*b*, for instance, a blade (e.g., paint scraper) or the like could be slid between the cover member 168 and the paneling 112 and then torqued (e.g., twisted) to separate the molding member 156 from the connection member 152. More specifically, the projecting member 164 may serve as a cam that induces removal of the molding member from the first jamb member 140 and the paneling 112 in a direction that is substantially perpendicular to the paneling 112 in response to the torquing from the blade and/or other tool. As a result, the molding member 156 may be removed substantially free of damage (e.g., cracking) occurring thereto.

It can be seen how the front of the first stud assembly 124 is set back with respect to the front of the first jamb member 140 or, in other words, how the front of the first jamb member extends past the front of the first stud assembly 124. In this regard, a space is provided that allows the paneling 112 to be mounted over the front surface of the first stud assembly 124 so that the front surface of the paneling is generally parallel to or level with the front of the first jamb member 140. Accordingly, the cover member 168 of the molding member 156 is configured to cover the interface 160 when the projecting member 164 and connection member 152 are seated in the groove 141 as discussed herein.

Figure 7A:
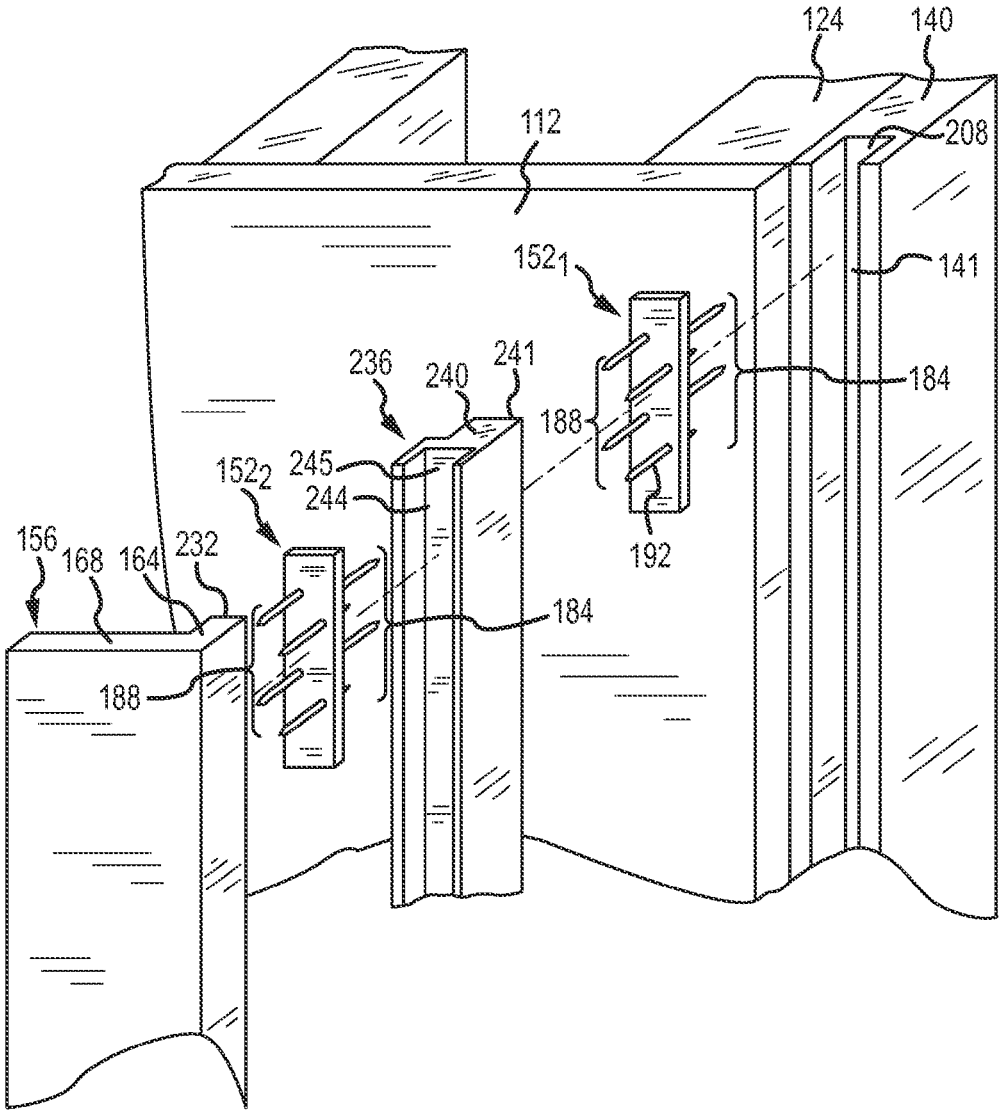
FIG. 7*a* is an exploded perspective view of a system for mounting molding onto a frame of door according to an embodiment.

In other contexts, as seen in FIG. 7*a*, a front surface of the paneling 112 may extend past a front of the first jamb member 140. In one arrangement, the molding member 156 of FIG. 7*a* could be designed or constructed so that its projecting member 164 is longer (i.e., in a direction away from the cover member 168) than that of the molding member 156 of FIG. 3*a* which would account for the front of the paneling 112 extending past the front of the first jamb member 140 and thereby allow the cover member 168 to conceal the interface 160 while resting substantially flat against the front surface of the paneling 112.

In another arrangement, and as seen in FIG. 7*a*, an extension member 236 may be used that is configured to space the cover member 168 of the molding member 156 away from the first jamb member 140 to allow for use of the same molding member 156 of FIG. 3*a* as will be discussed in more detail below. Broadly, the extension member 236 may serve as an adapter that is configured to interconnect the first jamb member 140 to the molding member 156 and thus space the cover member 168 of the molding member 156 away from the front of the first jamb member 140 so that the cover member 168 can rest flat against the front surface of the paneling 112. In some arrangements, the extension member 236 may be considered a portion of the molding member 156 or the first jamb member 140 (or other framing member). For instance, the molding member 156 may include first and second portions, where the member 156 is a first portion and the extension member 236 is a second portion. As another example, the first jamb member 140 may include first and second portions, where the member 140 is a first portion and the extension member 236 is a second portion.

In any event, the extension member 236 may include first and second opposite sides, where the first side includes a projecting member 240 that is configured to be received in the groove 141 of the first jamb member 140, and where the second side includes a groove 244 that is configured to receive the projecting member 164 of the molding member 156. In this regard, the projecting member 240 and a first connection member $\mathbf{152}_1$ are configured to be received and seated in the groove 141 of the first jamb member 140 and the projecting member 164 and a second connection member $\mathbf{152}_2$ are configured to be received and seated in the groove 244 of the extension member 236.

Figure 23:
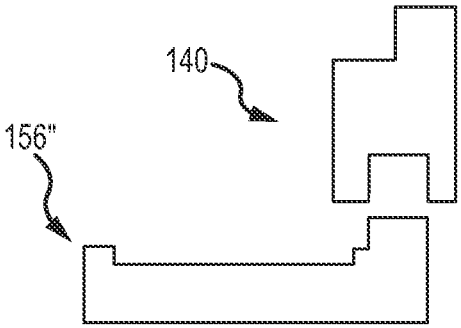
FIG. 23 is a plan view of a system for mounting molding onto a frame according to an embodiment.

In use, the first connection member $\mathbf{152}_1$ may be inserted into the groove 141 so that the first fastening apparatus 184 engages with the back surface 208 of the groove 141 (e.g., via the tool 212 of FIGS. 5*a*-5*c* and/or in other manners) as discussed previously. The projecting member 240 of the extension member 236 may then be aligned with and inserted into or received in the groove 141 (e.g., via a rubber mallet or the like as discussed above) so that the second fastening apparatus 188 of the first connection member $\mathbf{152}_1$ engages with an end surface 241 of the extension member 236. The second connection member $\mathbf{152}_2$ may then be inserted into the groove 244 of the extension member 236 so that the first fastening apparatus 184 engages with a back surface 245 of the groove 244 (e.g., via the tool 212 of FIGS. 5*a*-5*c* and/or in other manners). The projecting member 164 of the molding member 156 may then be aligned with and inserted into or received in the groove 244 (e.g., via a rubber mallet or the like as discussed above) so that the second fastening apparatus 188 of the second connection member $\mathbf{152}_2$ engages with the end surface 232 of the molding member 156. See FIG. 7*b*. FIG. 23 presents another embodiment of a molding member 156" being inserted into the extension member 236.

Figure 7B:
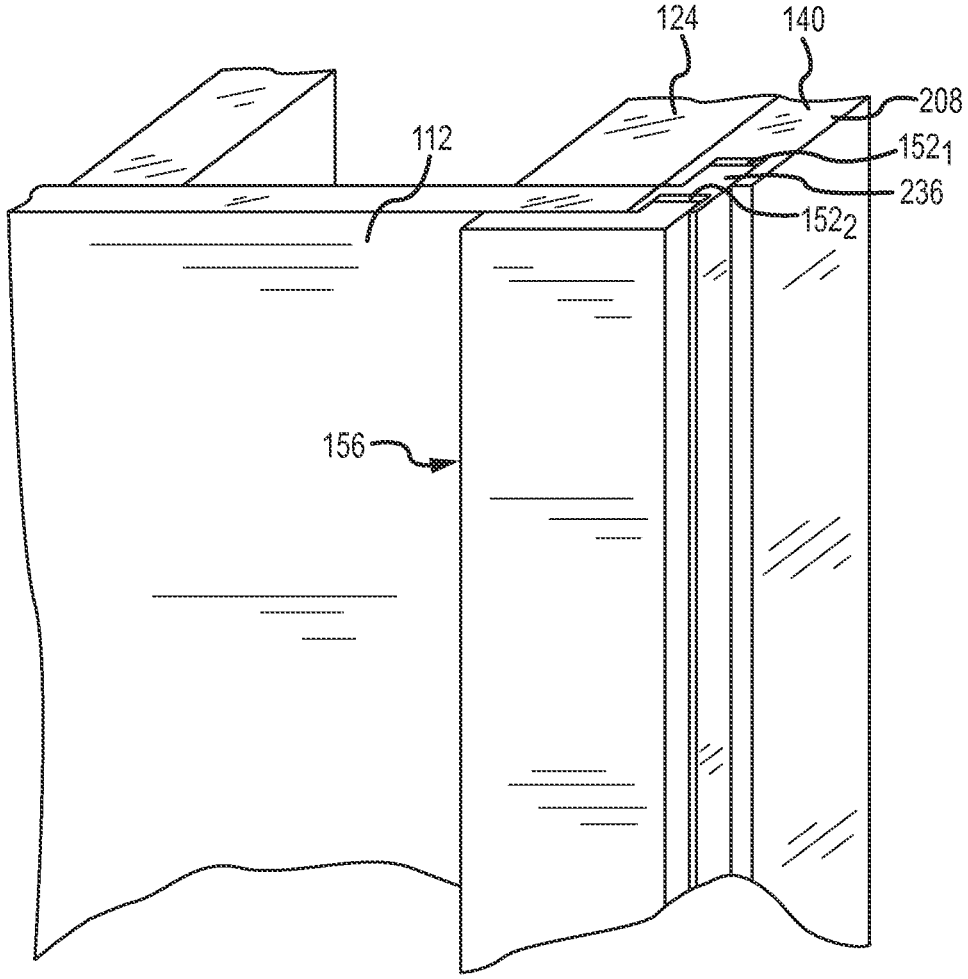
FIG. 7*b* is a perspective view similar to FIG. 7*a* but where the molding is mounted onto the frame of the door.
Figure 8:
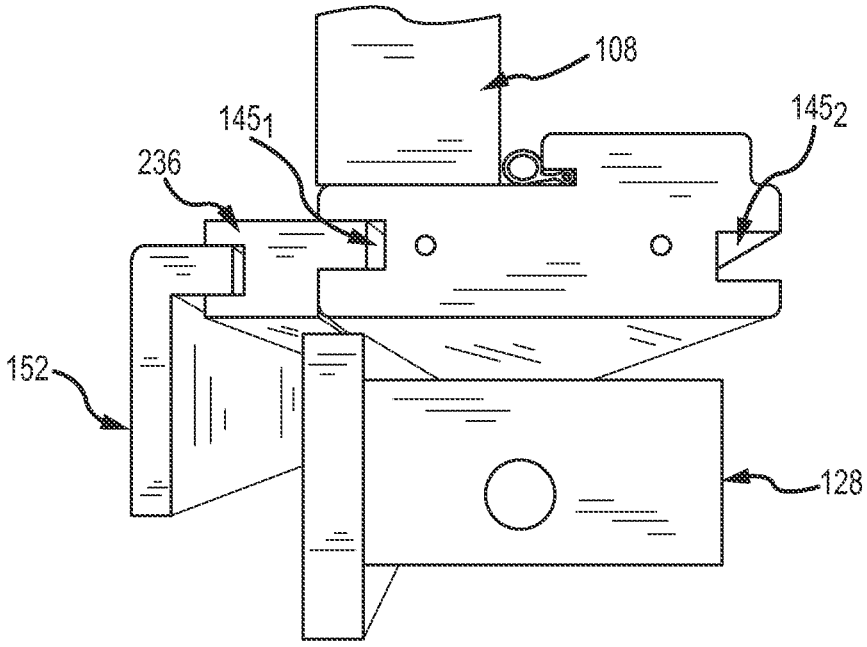
FIG. 8 is a top view of an embodiment similar to that in of FIG. 7*b*.

FIG. 8 presents a top view of the embodiment of FIGS. 7*a*-7*b* but being attached to the second jamb member 144. Furthermore, the second jamb member 144 includes first and second opposite grooves $\mathbf{145}_1$, $\mathbf{145}_2$ on opposite sides of the second jamb member 144. This arrangement advantageously allows for molding members to be secured to opposite sides of the frame 104 (labeled in FIG. 1), such as for an interior door frame and/or the like. While only the second jamb member 144 has been shown with first and second grooves, it is to be understood that any of the framing members (e.g., the first jamb member 140, the cross member 148, etc.) could include first and second opposite grooves (e.g., in the embodiment of FIGS. 3*a*-3*b*, the embodiment of FIGS. 7*a*-7*b*, etc.) for purposes of facilitating the mounting of molding members on opposite sides of the framing members.

While much of the discussion herein was in relation to the first jamb member 140, it is to be understood that the discussion may be equally applicable to other framing members (e.g., second jamb member 144, cross member 148) so as mount molding members about an entirety or substantial entirety of a frame (e.g., of frame 104 of FIG. 1). For instance, a connection member 152 may be inserted into and seated in the groove 149 of the cross member, a projecting member 164 of a molding member 152 may be inserted into the groove 149 and engaged with the connection member 152, etc.

The molding members 156 can be mounted to frames in different orders than those specifically discussed above. For instance, the second fastening apparatus 188 of a connection member 152 may be engaged with the end surface 232 of a molding member and then the projecting member 164 and connection member 152 may be inserted into and seated in the groove (e.g., the groove 141 in the embodiment of FIGS. 3*a*-3*b* or the groove 244 in the embodiment of FIGS. 7*a*-7*b*). In one arrangement, molding members 156 may be provided or supplied with connection members 152 already secured to the projecting members 164 (e.g., via adhesives, fasteners, an integral connection, etc.).

Furthermore, it is to be understood that the projecting member and groove pairs of the various systems and embodiments thereof disclosed herein may be arranged vice versa. In the embodiment of FIGS. 3*a*-3*b*, for instance, the projecting member 164 of the molding member 156 may be replaced with a groove and the groove 141 of the first jamb member 140 may be replaced with a projecting member. In this regard, the connection member 152 may be inserted into the groove of the molding member 156 or engaged with the end surface of the projecting member of the first jamb member 140, and then the projecting member of the first jamb member 140 be received in the groove of the molding member 156. In the embodiment of FIGS. 7*a*-7*b*, for instance, the groove 141 and projecting member 240 could be replaced with a projecting member and groove, respectively, and the groove 244 and projecting member 164 could be replaced with a projecting member and groove, respectively.

Figure 12:
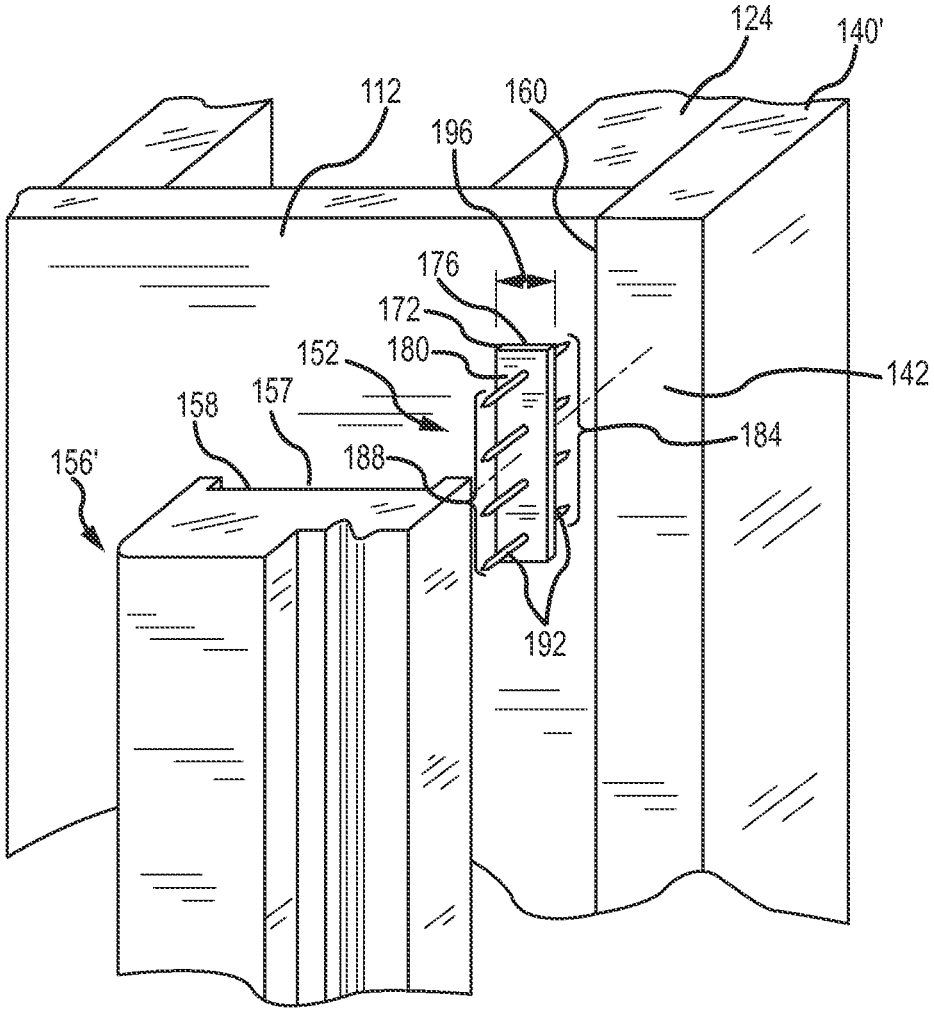
FIG. 12 is an exploded perspective view of a system for mounting molding onto a frame of a door according to an embodiment.

The various connection members 152 need not necessarily be sandwiched (e.g., compressed) between a surface (e.g., back surface) of a groove and an end of a projecting member to interconnect a molding member over an interface of building or structural components. For instance, FIG. 12 illustrates another system for mounting molding onto a frame of a door (or other structure such as a window, etc.) similar to the system of FIG. 3*a*, but where the first jamb member 140' (e.g. or other framing member) does not include the groove 141 therein. Rather, the first jamb member 140' includes a front surface 142 through which the fasteners 192 of the first fastening apparatus 184 are configured to pierce and against which the first surface 176 of the body 172 is configured to engage or abut. As shown, the front surface 142 may be level with the front surface of the paneling 112. In this embodiment, a molding member 156' may include a groove 157 (e.g., depression, track, etc.) therein into which the connection member is configured to be seated (e.g., via the fasteners 192 of the second fastening apparatus 188 piercing through a back surface 158 of the groove 157).

Figure 13:
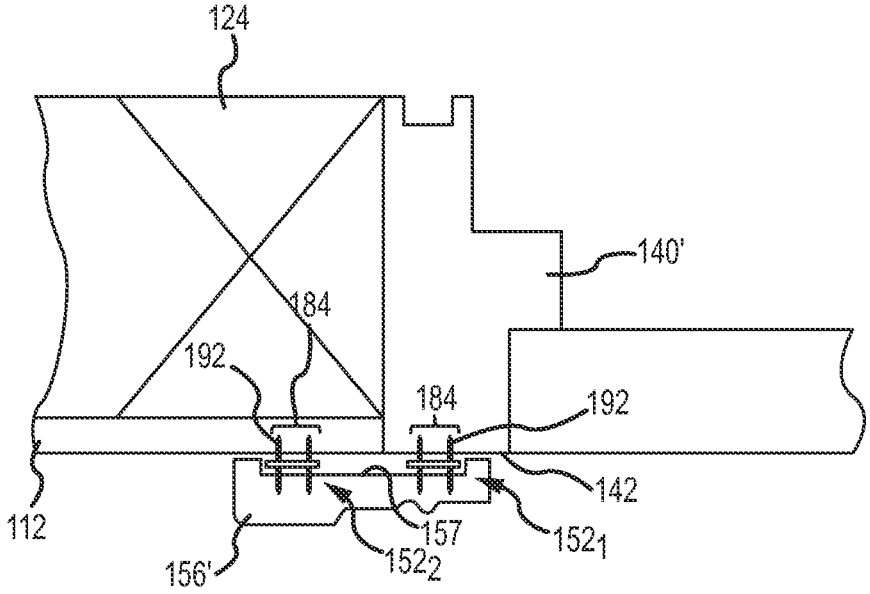
FIG. 13 is a sectional view of a system for mounting molding onto a frame of a door according to an embodiment.

FIG. 13 illustrates another embodiment of the system similar to that shown in FIG. 12 but that includes first and second connection members $\mathbf{152}_1$, $\mathbf{152}_2$ seated in the groove 157 of the molding member 156'. For instance, the fasteners 192 of the first fastening apparatus 184 of the first connection member $\mathbf{152}_1$ may be configured to pierce through the front surface 142 of the first jamb member 140' (or other framing member) while the fasteners 192 of the first fastening apparatus 184 of the second connection member $\mathbf{152}_2$ may be configured to pierce through the paneling 112 and into the first stud assembly 124 (or other structural or building component).

Figure 14:
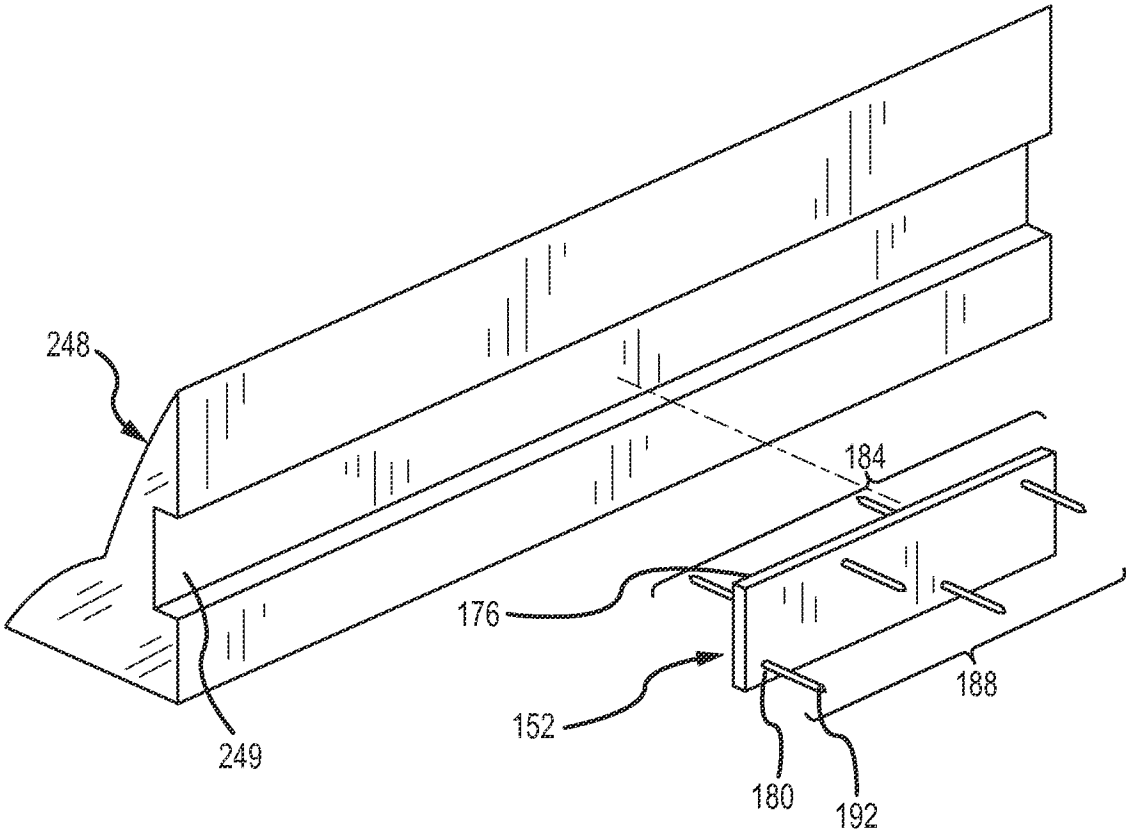
FIG. 14 is an exploded perspective view of a molding member in the form of a baseboard and including a groove into which a connection member may be disposed according to an embodiment.
Figure 15:
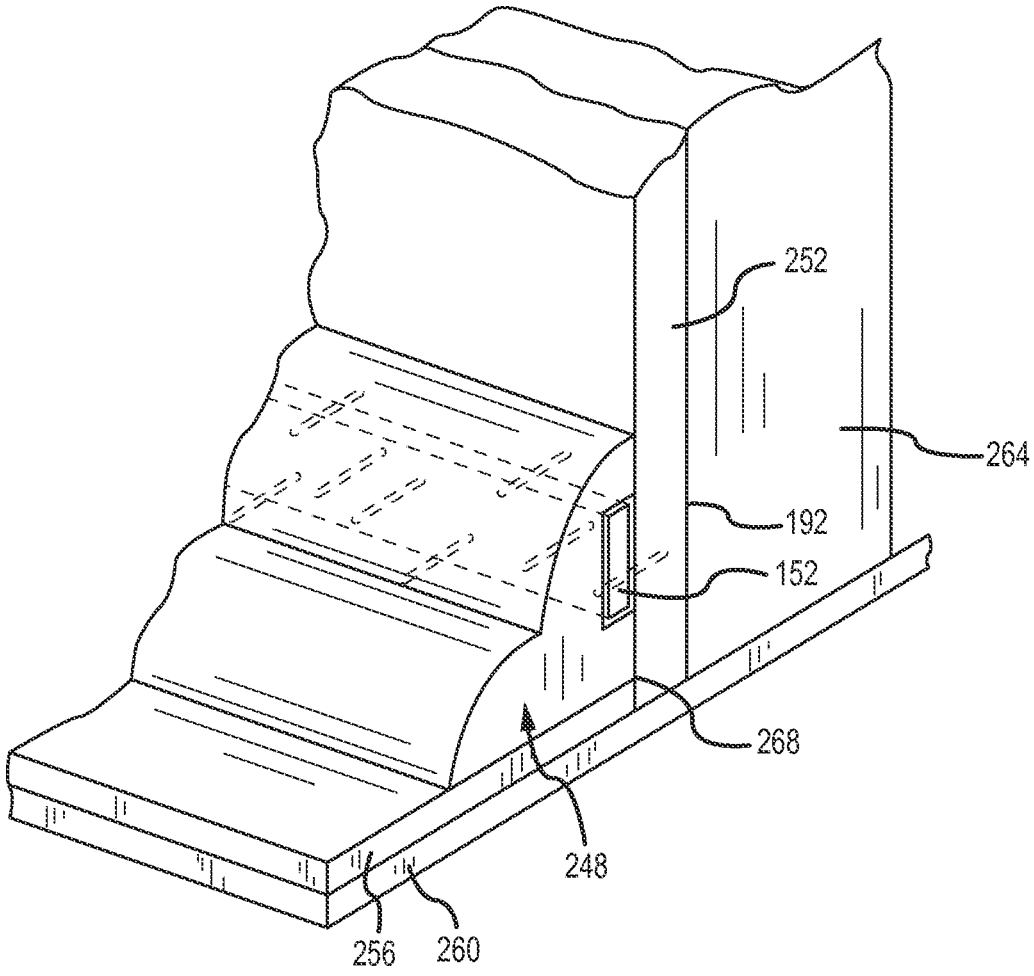
FIG. 15 illustrates the baseboard and connection member of FIG. 9 being mounted onto the base of a wall.

In one variation, an individual connection member may be configured to simultaneously engage with the first jamb member 140' (or other framing member) and the first stud assembly 124 (or other structural or building component). For instance, the connection member 152 of FIG. 12 may be rotated 90 degrees (e.g., perpendicular to its position shown in FIG. 12) so as to cross over the interface 160 to allow the fasteners 192 of the first fastening apparatus 184 to simultaneously engage with the first jamb member 140' and the first stud assembly 124. As another example, the connection member 152 of FIG. 12 could, in the event that the fasteners 192 of the first fastening apparatus 184 staggeredly extend from the first surface 176 of the body 172, be disposed so as to substantially directly overlay the interface 160 so that at least some of the fasteners 192 engage with the first jamb member 140' and at least some of the fasteners 192 engage with the first stud assembly 124. FIG. 14 presents a perspective view of another embodiment of the system including another molding member 248 (e.g., baseboard) including a groove 249 on a backside thereof into which a connection member 152 may be received and seated. After the connection member 152 has been at least partially seated in the groove 249 (e.g., via the tool 212 of FIGS. 5*a*-5*c* and/or in other appropriate manners), the molding member 248 may be secured adjacent a base of a wall 252 (e.g., drywall or the like) as shown in FIG. 15. For instance, the molding member 248 may be initially placed onto a top of a flooring surface 256 (where the flooring surface 256 is disposed over any appropriate subflooring 260).

Thereafter, the molding member 248 may be forced against the wall 252 (e.g., via hammering the molding member 248 with a rubber mallet or the like) to drive fasteners 192 of the connection member 152 through the wall 252 and into one or more studs 264 or other structural members behind the wall 252 and thereby conceal an interface 268 between the wall 252 and flooring surface 256. In one arrangement, the connection member 152 span a substantial entire length of the molding member 248 so that at least some of the fasteners 192 of the connection member 152 may engage with studs 264 (e.g., in the case where adjacent parallel studs are spaced apart by 16" or the like). In another arrangement, a plurality of smaller individual connection members 152 may be respectively seated in the groove 249 of the molding member 248 and spaced apart by the same spacing between adjacent studs 264 or other structural members.

Figure 16:
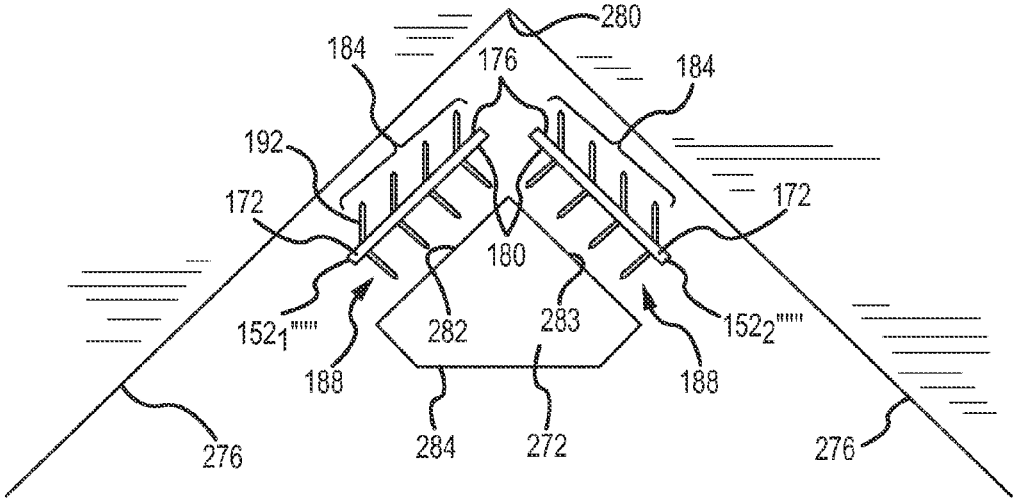
FIG. 16 is a sectional view of a system for mounting molding onto a frame of a door according to an embodiment.

In some arrangements, the connection members 152 may be used to secure molding members 156 and/or other members (e.g., decorative pieces) over interfaces (e.g., corners) between two non-parallel (e.g., perpendicularly-arranged) or non-coplanar building components. Turning now to FIG. 16, another embodiment of the system is illustrated that is useful for mounting a molding member 272 (e.g., decorative piece, etc.) over an interface 280 between adjacent, perpendicular wall surfaces 276. At least one connection member 152""" may be used whereby the fasteners 192 of the first fastening apparatus 184 are disposed at a non-perpendicular angle relative to the first surface 176 of the body 172. For instance, the fasteners 192 of the first fastening apparatus 184 of a first connection member $\mathbf{152}_1$""" may extend at a positive 45° relative to the first surface 176 of the body 172 while those of a second connection member $\mathbf{152}_2$"""" may extend at a negative 45° relative to the first surface 176 of the body 172. See FIG. 16.

In use, for example, the fasteners 192 of the second fastening apparatus 188 of the first and second connection members $\mathbf{152}_1$"""", $\mathbf{152}_2$"""" may be driven into respective first and second surfaces 282, 283 of the molding member 272. While not shown, the first and second surfaces 282, 283 may include grooves (e.g., depressions, tracks) as discussed herein into which the connection members may be seated. In any event, the molding member 272 may then be aligned over the interface 280 and the fasteners 192 of the second fastening apparatus 188 of the first and second connection members $\mathbf{152}_1$"""", $\mathbf{152}_2$"""" driven into the adjacent walls 276 (e.g., via driving (e.g., hammering) a hammer or the like (e.g., rubber mallet) against a third surface 284 of the molding member 272).

As shown, the connection members may be constructed or selected so that the fasteners 192 being driven into the walls 276 are substantially perpendicular to the surface of the molding member 272 being hammered by the hammer or other tool (e.g., the third surface 284). Stated differently, the fasteners 192 being driven into the walls 276 may be angled so that they are oriented substantially parallel to the direction of force being applied by the hammer or other tool. This arrangement advantageously facilitates driving of the fasteners 192 into the walls 276 via increased transfer of the force applied to the third surface 284 to the fasteners 192 being driven into the walls 276.

While not shown, the system of FIG. 16 could also be arranged vice versa whereby the fasteners 192 disposed at the non-perpendicular angle to the body 172 are engaged with (e.g., inserted into) the first and second surfaces 282, 283 of the molding member 272 rather than into the adjacent walls 276. For instance, the fasteners 192 of the second fastening apparatuses 188 of each of the first and second connection members $\mathbf{152}_1$"""", $\mathbf{152}_2$"""" may be appropriately driven into the adjacent walls 276 so that the fasteners 192 of the first fastening apparatuses 184 of each of the first and second connection members $\mathbf{152}_1$"""", $\mathbf{152}_2$"""" all extend away from the adjacent walls 276 in a direction that is substantially perpendicular to the third surface 284 and non-perpendicular to the first and second surfaces 282, 283. Thereafter, the molding member 272 may then be aligned over the interface 280 and the molding member 272 driven against the fasteners 192 of the first fastening apparatuses 184 of the first and second connection members $\mathbf{152}_1$"""", $\mathbf{152}_2$"""" to pierce and drive the fasteners 192 into the first and second surfaces 282, 283 of the molding member 272 and mount the molding member 272 against the walls 276 (e.g., and over the interface 280).

While FIG. 16 illustrates use of the disclosed connection members to secure a molding member to an inside corner between two adjacent walls, the disclosed connection members could also similarly be used to secure a molding member to an outside corner between two adjacent walls.

Figure 17A:
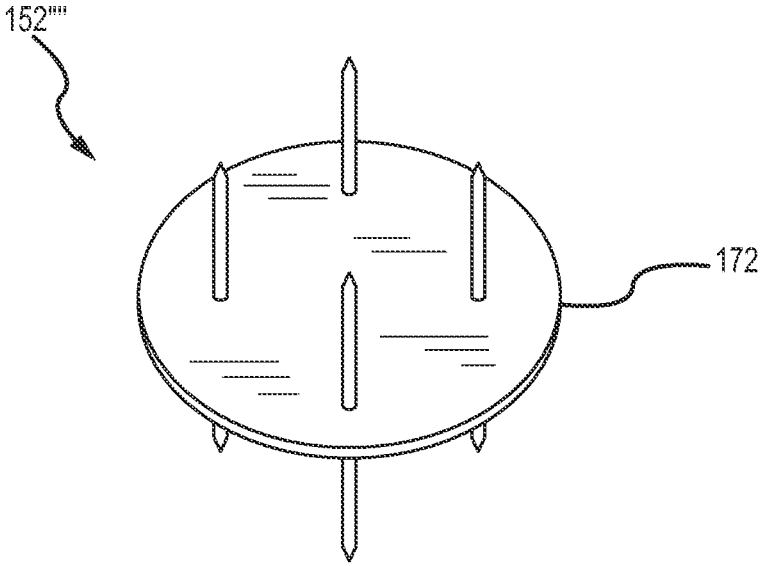
FIG. 17*a* is a perspective view of a connection member according to an embodiment.
Figure 17B:
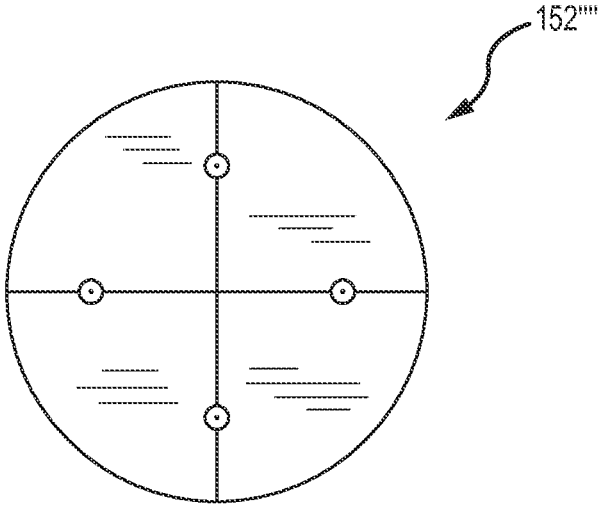
FIG. 17*b* is a plan view of the connection member of FIG. 17*a*.
Figure 18A:
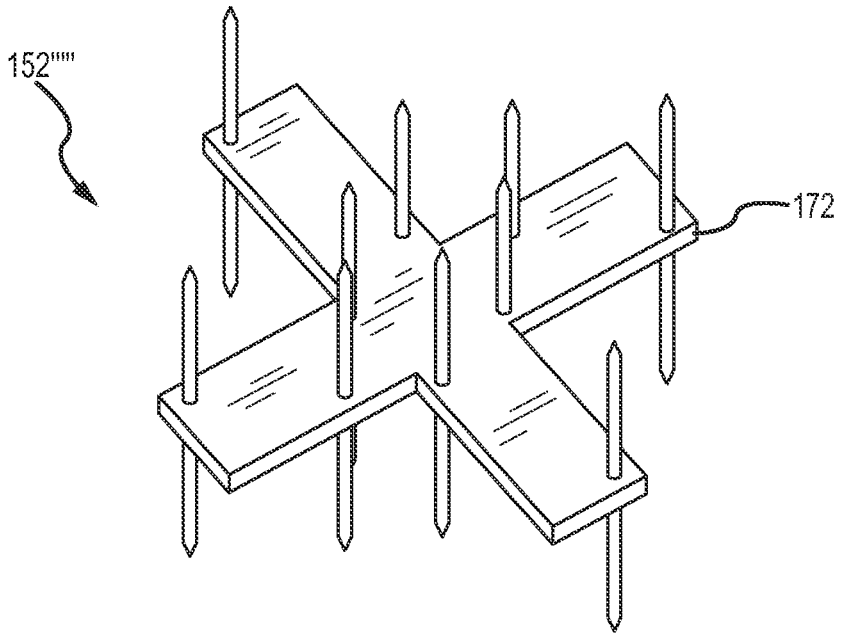
FIG. 18*a* is a perspective view of a connection member according to an embodiment.
Figure 18B:
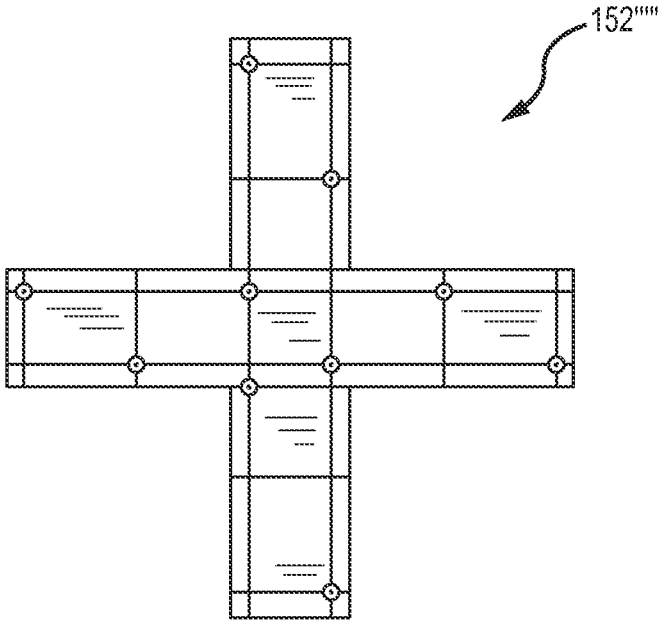
FIG. 18*b* is a plan view of the connection member of FIG. 18*a*.

The body 172 of the various connections members 152 disclosed herein is not necessarily limited to elongated layers or substantially planar members as shown in the drawings and various other shapes and sizes are envisioned and included herein depending upon the particular end use. For instance, FIGS. 17*a*-17*b* illustrate a connection member 152"" having a body 172 that is substantially circular while FIGS. 18*a*-18*b* illustrate a connection member 152"""" having a body 172 that is substantially cross-shaped. As another example, the thickness of the body 172 of the connection member 152 may in some situations be greater than shown in the disclosed drawings (e.g., approaching its width). One or more combinations of the various systems and embodiments thereof disclosed herein may be combined into kits in any appropriate manner. For instance, one or more molding members (e.g., molding member 156 and/or molding member 248) and/or connection members 152 may be supplied in the same packaging for use in mounting molding to a door frame, window frame, base of a wall, and the like.

Figure 24:
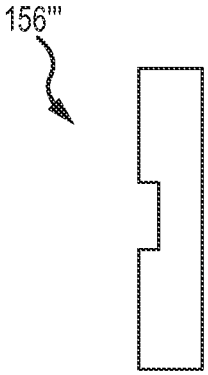
FIG. 24 is an end view of a molding member according to an embodiment.

The various components disclosed herein may be manufactured in any appropriate manner(s), shapes, sizes, dimensions, and material(s). For instance, FIG. 24 presents another embodiment of a molding member 156"". Furthermore, while the frame 104 has been discussed in the context of door and windows, it is to be understood that the disclosed systems may be utilized in numerous contexts in which it is desired to cover or conceal interfaces between structural components of a building via molding or the like. Still further, the connection members disclosed herein may be used to mount various members (e.g., decorative, molding, etc.) onto or over building components (e.g., walls) even when doing so does not cover an interface between building components (e.g., in the middle of a wall).

Still further, while the invention has been illustrated and described in detail in the drawings and foregoing description, such illustration and description is to be considered as exemplary and not restrictive in character. As an example, the connection members 152 may additionally or alternatively in some embodiments be configured to engage one or both opposite side surfaces of the groove 141 (e.g., in addition to or instead of the back surface 208). In one arrangement, the body 172 may include one or more fastening apparatuses disposed on or extending from one or both opposite side surfaces (not labeled) of the body 172 (between the first and second surfaces 176, 180). For instance, one or more fasteners may extend away from one or both of the side surfaces and be disposed at an acute angle to the side surfaces in a direction away from the first surface 176 and towards the second surface 180. This arrangement would facilitate entry of the body 172 into the groove 141 but inhibit removal of the body 172 from the groove 141 (e.g., due to the fasteners on the side surfaces of the body 172 engaging with the opposite side surfaces of the groove 141).

In another embodiment, the fasteners 192 of one of the first and second fastening apparatuses 184, 188 of the connection member 152 may be in the form of screws having threads that are configured to be threaded into the molding member 156 or framing member (or other component). With reference to FIG. 3*a*, for instance, assume the fasteners 192 of the first fastening apparatus 184 are screws and that the heads of the screws are accessible via the second surface 180 of the body 172. Also assume the fasteners 192 of the second fastening apparatus 188 are nails as shown (e.g., where the nails would not be disposed directed over the screws to allow for access to the screw heads). In this regard, the connection member 152 could be inserted into the groove 141 and a tool (e.g., screwdriver, drill) could be engaged with the heads of the screws to thread the screws into the back surface 208 of the groove 141 (e.g., which may be preceded by drilling corresponding holes into the back surface 208). Thereafter, the projecting member 164 of the molding member 156 could be aligned, inserted, and forced into the groove to engage with the fasteners 192 of the second fastening apparatus 188 as discussed previously.

Figure 19:
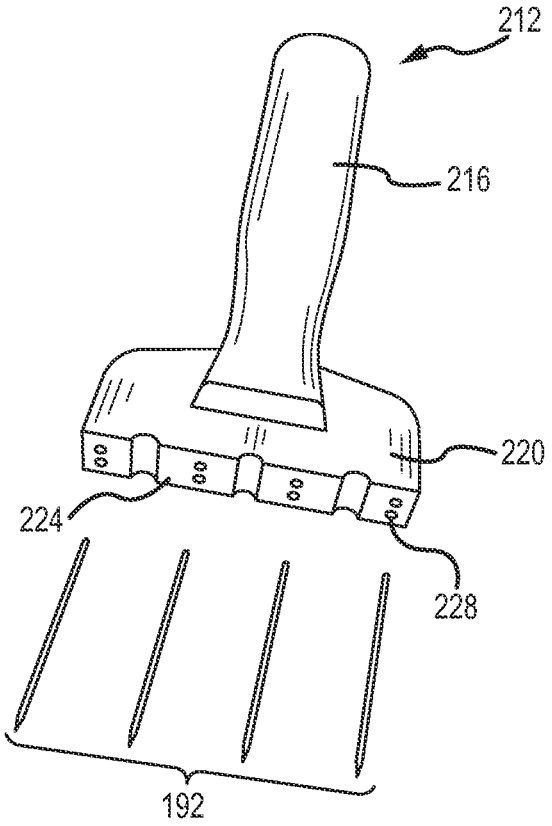
FIG. 19 is a perspective view of the tool of FIGS. 5*a*-5*c* and a plurality of fasteners configured to be inserted into apertures of the tool.
Figure 20:
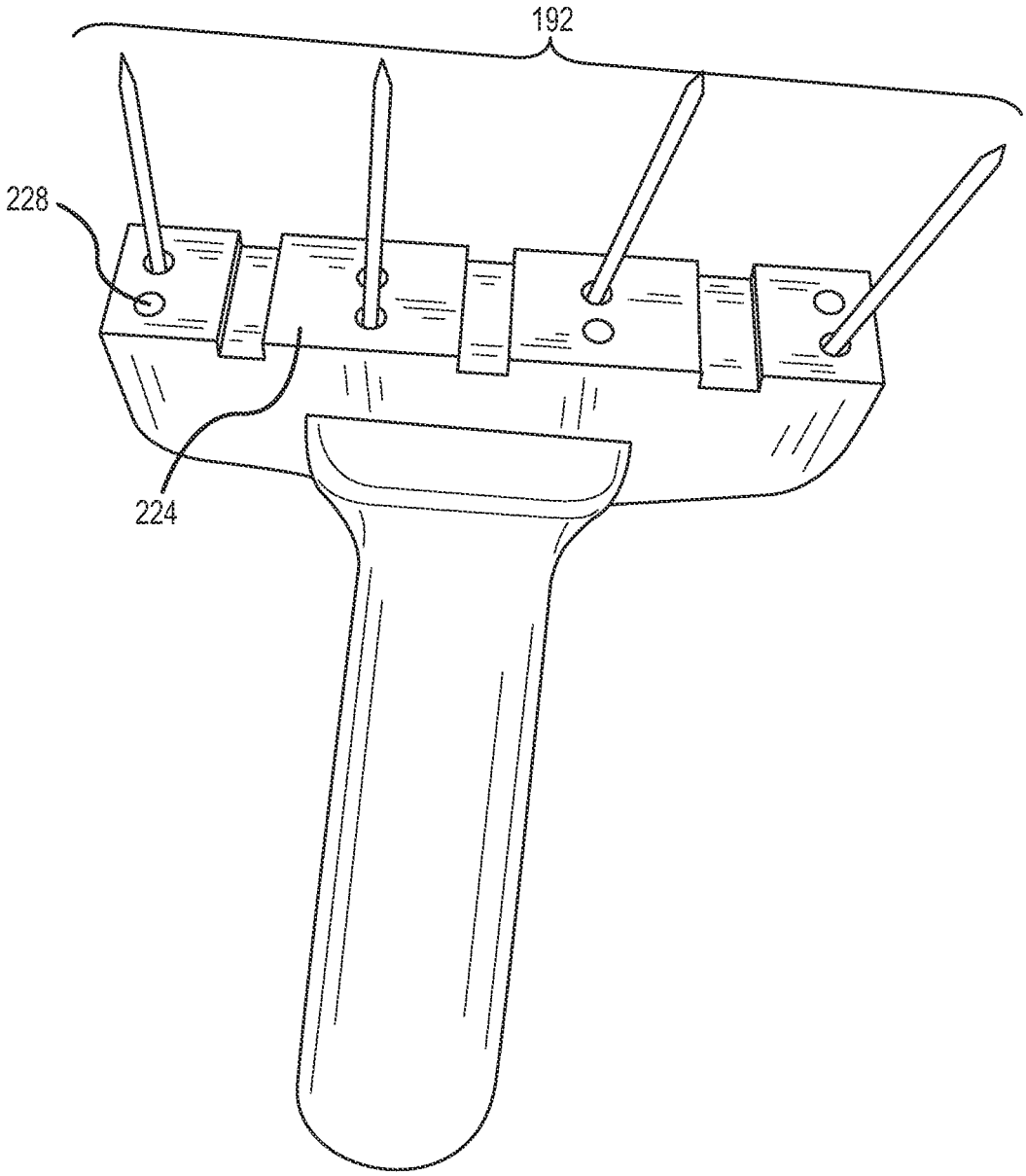
FIG. 20 is a perspective view of the tool of FIGS. 5*a*-5*c* and a plurality of fasteners received in the apertures of the tool.

In another embodiment, the tool 212 of FIGS. 5*a*-5*c* may be used to insert fasteners (e.g., fasteners 192) into molding members (e.g., molding members 156, molding members 272, etc.), framing members (e.g., first jamb member 140), etc. free of the base member 172 of the connection members 152. Stated differently, the tool 212 may in some situations be used to insert loose fasteners into molding members, framing members, and the like. With reference to FIGS. 19-20, for instance, one or more fasteners 192 (e.g., nails, pins, etc.) may be respectively inserted into one or more of the apertures 228 through the mounting surface 224 of the mounting head 220. A user may then grasp the handle 216 and use the tool 212 to drive the fasteners 192 into a surface of a molding member, framing member (e.g., the back surface of a groove, a front surface when no groove is present, etc.), and/or the like. The user may then take the molding member or the like, dispose the same against a framing member, wall, panel, etc., and forcibly drive (e.g., hammer) the molding member against the framing member, wall, panel, etc. to drive the fasteners into the framing member, wall, panel, etc. and thereby mount the molding member thereover.

While this disclosure contains many specifics, these should not be construed as limitations on the scope of the disclosure or of what may be claimed, but rather as descriptions of features specific to particular embodiments of the disclosure. Certain features that are described in this specification in the context of separate embodiments and/or arrangements can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

The foregoing description of the present invention has been presented for purposes of illustration and description. It is to be understood that the drawings are not necessarily drawn to scale. Furthermore, any use of "first," "second," etc. (e.g., first jamb member, second jamb member, etc.) is merely for purposes of facilitating the reader's understanding of the invention and does not preclude a component labeled as a "first" component from being the "second" component and vice versa. Still further, the description is not intended to limit the invention to the form disclosed herein. Consequently, variations and modifications commensurate with the above teachings, and skill and knowledge of the relevant art, are within the scope of the present invention.

What is claimed is:

1. A method of mounting a molding member over an interface between a framing member and a component of a building, wherein the molding member includes one of a groove and a projecting member, wherein the framing member includes the other of a groove and a projecting member, and wherein the method comprises:

securing the framing member to the component of the building;

disposing, after the securing, a body of a connection member at least partially into the groove, wherein the body includes first and second opposite surfaces, wherein the connection member includes a first fastening apparatus on the first surface of the body, and wherein the connection member includes a second fastening apparatus on the second surface of the body;

first engaging, during the disposing, the first fastening apparatus with a surface defining the groove;

aligning, after the disposing, the one of the groove and projecting member of the molding member with the other of the groove and projecting member of the framing member;

receiving the projecting member in the groove; and second engaging, during the receiving, the projecting member with the second fastening apparatus to mount the molding member over the interface, wherein the body is disposed within the groove between the projecting member and the surface of the groove.

2. The method of claim 1, wherein the molding member includes first and second opposite sides, wherein the one of the groove and projecting member of the molding member is disposed on a first side of the molding member, and wherein the method further includes:

applying a force to the second side of the molding member, wherein the receiving occurs during the applying.

3. The method of claim 1, wherein the second engaging includes piercing the projecting member with the second fastening apparatus.

4. The method of claim 1, wherein the first engaging includes piercing the surface of the groove with the first fastening apparatus.

5. The method of claim 1, further including compressing, during the receiving, the body between the projecting member and the surface of the groove.

* * * * *